US008899579B2

(12) United States Patent
Gamo

(10) Patent No.: US 8,899,579 B2
(45) Date of Patent: Dec. 2, 2014

(54) SHEET PROCESSING APPARATUS AND IMAGE FORMING APPARATUS

(75) Inventor: Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/558,241

(22) Filed: Jul. 25, 2012

(65) Prior Publication Data

US 2013/0026702 A1 Jan. 31, 2013

(30) Foreign Application Priority Data

Jul. 29, 2011 (JP) ..... 2011-167586

(51) Int. Cl.

| | |
|---|---|
| ***B65H 31/12*** | (2006.01) |
| ***G03G 15/00*** | (2006.01) |
| ***B65H 31/10*** | (2006.01) |
| ***B65H 31/34*** | (2006.01) |

(52) U.S. Cl.

CPC ..... *B65H 31/34* (2013.01); *B65H 2301/4213* (2013.01); *G03G 15/6552* (2013.01); *B65H 2701/18292* (2013.01); *B65H 2404/693* (2013.01); *B65H 2402/33* (2013.01); *B65H 2404/61* (2013.01); *B65H 2404/691* (2013.01); *B65H 31/10* (2013.01); *B65H 2801/27* (2013.01)

USPC ..... 271/218; 271/220; 271/213; 270/58.08; 270/58.07

(58) Field of Classification Search

USPC ..... 271/213, 214, 218, 220; 270/58.07, 270/58.08, 58.11, 58.12, 58.14

See application file for complete search history.

(56) References Cited

U.S. PATENT DOCUMENTS

| | | | | |
|---|---|---|---|---|
| 5,026,034 | A * | 6/1991 | Russel et al. | 271/220 |
| 5,398,918 | A | 3/1995 | Rizzolo | |
| 6,142,461 | A * | 11/2000 | Asao et al. | 270/58.09 |
| 6,244,583 | B1 * | 6/2001 | Ohmichi et al. | 270/58.09 |
| 6,685,180 | B2 * | 2/2004 | Saegusa et al. | 270/58.08 |
| 6,962,331 | B2 * | 11/2005 | Matsumoto et al. | 270/58.09 |
| 6,994,339 | B2 * | 2/2006 | Kato et al. | 270/58.12 |
| 7,007,948 | B2 * | 3/2006 | Kamiya et al. | 271/221 |
| 8,408,540 | B2 * | 4/2013 | Uchiyama et al. | 271/220 |
| 2011/0285071 | A1 * | 11/2011 | Miyake et al. | 270/58.07 |

* cited by examiner

*Primary Examiner* — Ernesto Suarez

(74) *Attorney, Agent, or Firm* — Canon USA Inc IP Division

(57) ABSTRACT

A sheet processing apparatus and an image forming apparatus move, when stacking a sheet on a stacking tray, a supporting tray disposed to freely appear above the stacking tray to a first position in which the supporting tray projects above the stacking tray and supports the sheet stacked on an intermediate stacking tray. When these apparatuses discharge a processed sheet bundle, these apparatuses move the supporting tray from the first position to a second position in which the supporting tray supports an edge of the discharged sheet in an upstream side in a discharging direction, and guides the moving sheet bundle to a stacking wall. Further, these apparatuses move the supporting tray from the second position to a third position at predetermined timing, so that the supporting tray stops supporting the sheet bundle and stacks the sheet bundle on the sheet bundle previously stacked on the stacking tray.

13 Claims, 21 Drawing Sheets

SHEET PROCESSING APPARATUS AND IMAGE FORMING APPARATUS

BACKGROUND OF THE INVENTION

1. Field of the Invention

The present disclosure relates to a sheet processing apparatus and an image forming apparatus. In particular, the present disclosure relates to a configuration for improving a stacking property of sheet bundles which are processed and discharged to a stacking tray.

2. Description of the Related Art

Conventionally, there is an image forming apparatus, such as a copying machine, a laser beam printer, a facsimile, and a multifunction peripheral including functions of such devices, which includes a sheet processing apparatus. The sheet processing apparatus performs processing such as stapling, punching, and sorting with respect to sheets on which images are formed. Further, an image forming apparatus (i.e., an image forming system) is widely known, in which the sheet processing apparatus is connected to a discharge port of an image forming apparatus main body, and automatically performs the above-described processing on the sheets online.

A widely-used sheet processing apparatus includes an intermediate processing tray therein, stacks a plurality of sheets on the intermediate processing tray to form a sheet bundle, and staples the sheet bundle. Such a sheet processing apparatus discharges the stapled sheet bundle from a discharge port to a tilted stacking tray (refer to U.S. Pat. No. 5,398,918).

In the conventional sheet processing apparatus, the sheet bundle discharged to the stacking tray slides downwards due to self-weight and the tilt of the stacking tray. The sheet bundle then comes into contact with an alignment wall disposed below the discharge port. As a result, an end of the sheet bundle in an upstream side in a discharging direction becomes aligned, so that a stacking property of the sheet bundles is improved.

However, when the sheet bundle slides downwards, the end of the sheet bundle in the upstream side in the discharging direction may become caught on a stapled portion (i.e., a staple ST) of a sheet bundle SA1 previously stacked on a stacking tray 137 as illustrated in FIG. 21. The sheet bundle may thus not come into contact with an alignment wall 137*a*, so that the stacking property of sheet bundles SA1 and SA2 on the stacking tray is deteriorated.

SUMMARY OF THE INVENTION

The present disclosure is directed to providing a sheet processing apparatus and an image forming apparatus capable of improving an alignment property of a sheet bundle which has been processed.

According to an aspect disclosed herein, a sheet processing apparatus includes a sheet processing portion configured to process sheets into a sheet bundle, a sheet stacking portion configured to stack thereon the sheet bundle discharged from a discharge port after being processed on the sheet processing portion, a regulating member disposed below the discharge port and configured to contact an upstream edge, in a discharging direction of the sheet bundle which is discharged to the sheet stacking portion, and to regulate a position of the upstream edge in the discharging direction of the sheet bundle, a sheet supporting unit disposed below the discharge port and moving to a first position to project above the sheet stacking portion and support the upstream edge in the discharging direction of the sheet bundle discharged to the sheet stacking portion, and to a second position to release supporting the discharged sheet bundle and stack the sheet bundle on a sheet bundle previously stacked on the sheet stacking portion, a moving unit configured to move the sheet supporting unit, and a control unit configured to control a movement of the moving unit so that, when a processed sheet bundle is discharged, the sheet supporting unit is moved to the first position, and at predetermined timing the sheet supporting unit is moved from the first position to the second position so as to bring the upstream edge in the discharging direction of the sheet bundle into contact with the regulating member after supporting the edge in the upstream side in the discharging direction of the sheet bundle.

According to an exemplary embodiment of the present disclosure, when the sheet processing apparatus discharges the sheet bundle, the sheet supporting unit supports the sheet bundle. The sheet supporting unit then stops supporting the sheet bundle at predetermined timing and stacks the sheet bundle on a sheet bundle which has been previously stacked on the sheet stacking portion. As a result, the alignment property of the processed sheet bundles can be improved.

Further features and aspects disclosed herein will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles of the disclosure.

DESCRIPTION OF THE EMBODIMENTS

Various exemplary embodiments, features, and aspects of the disclosure will be described in detail below with reference to the drawings.

Figure 1:
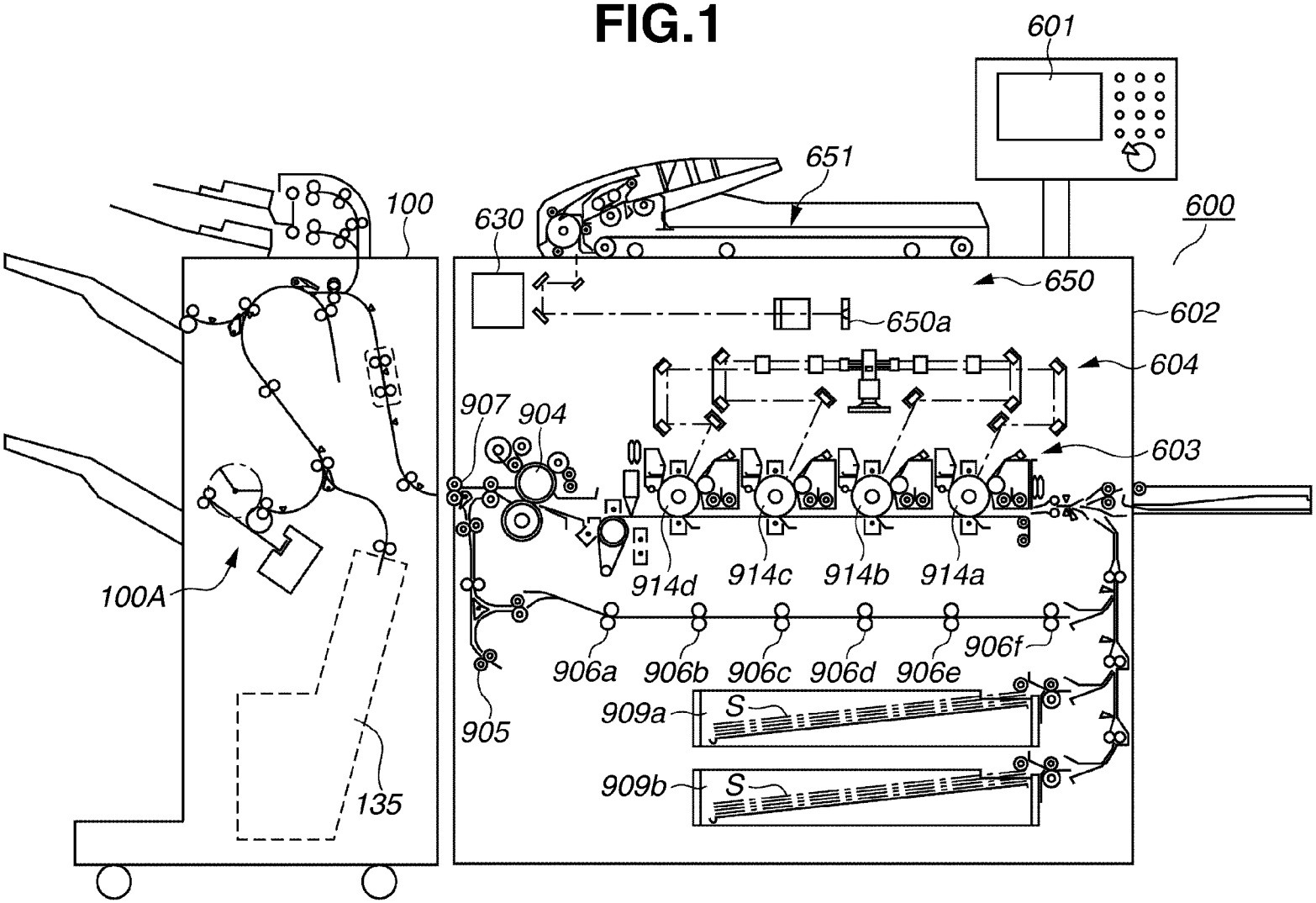
FIG. 1 illustrates a monochrome/color copying machine which is an example of an image forming apparatus including a sheet processing apparatus according to a first exemplary embodiment.

FIG. 1 illustrates a configuration of a monochrome/color copying machine which is an example of an image forming apparatus including a sheet processing apparatus according to a first exemplary embodiment.

Referring to FIG. 1, a monochrome/color copying machine 600 includes a monochrome/color copying machine main body (hereinafter referred to as a copying machine main body) 602. Further, the monochrome/color copying machine 600 includes a document reading unit (i.e., an image reader) 650 disposed on an upper portion of the copying machine main body 602, and a document conveyance apparatus 651 which automatically reads a plurality of documents.

The copying machine main body 602 includes sheet feed cassettes 909*a* and 909*b*, an image forming unit 603, and a fixing unit 904. Normal sheets S on which images are to be formed are stacked on the sheet feed cassettes 909*a* and 909*b*. The image forming unit 603 forms a toner image on the sheet employing an electrophotographic process, and the fixing unit 904 fixes the toner image formed on the sheet. Further, an operation unit 601 for a user to perform various inputs and specify settings to the copying machine main body 602 is connected on an upper surface of the copying machine main body 602. Furthermore, a finisher 100, i.e., a sheet processing apparatus, is laterally connected to the copying machine main body 602. A central processing unit (CPU) circuit 630 is a control unit which controls the copying machine main body 602 and the finisher 100.

When the monochrome/color copying machine 600 forms on the sheet an image of a document (not illustrated), an image sensor 650*a* in the document reading unit 650 reads the image of the document conveyed by the document conveyance apparatus 651. The document reading unit 650 then inputs the read digital data to an exposure apparatus 604, and the exposure apparatus 604 irradiates a photosensitive drum 914 (i.e., photosensitive drums 914*a*, 914*b*, 914*c*, and 914*d*) in the image forming unit 603 with light according to the digital data. An electrostatic latent image is thus formed on a photosensitive drum surface. The monochrome/color copying machine 600 develops the electrostatic latent image formed on each of the photosensitive drums 914*a*, 914*b*, 914*c*, and 914*d*, so that yellow, magenta, cyan, and black toner images are formed on the surface of the photosensitive drums 914*a*, 914*b*, 914*c*, and 914*d* respectively.

The monochrome/color copying machine 600 transfers the four color toner images to the sheet fed from the sheet feeding cassette 909*a* or 909*b*. The fixing unit 904 then fixes the transferred toner images on the sheets. If the monochrome/color copying machine 600 is set to a mode for forming the image on one side of the sheet, the monochrome/color copying machine 600 directly discharges the sheet on which the toner image has been fixed, from a discharge roller pair 907 to the finisher 100 laterally connected to the copying machine main body 602.

In contrast, if the monochrome/color copying machine 600 is set to a mode for forming the image on both sides of the sheet, the monochrome/color copying machine 600 conveys the sheet from the fixing unit 904 to a reverse roller 905. The monochrome/color copying machine 600 then reverses the reverse roller 905 at predetermined timing, and conveys the sheet towards two-sided conveyance rollers 906*a*, 906*b*, 906*c*, 906*d*, 906*e*, and 906*f*. The monochrome/color copying machine 600 thus re-conveys the sheet to the image forming unit 603, so that the yellow, magenta, cyan, and black toner images are transferred on a back side of the sheet.

The monochrome/color copying machine 600 re-conveys to the fixing unit 904 the sheet of which the four color toner images are formed on the back side, and the fixing unit 904 fixes the toner image on the sheet. The monochrome/color copying machine 600 discharges the sheet from the discharge roller pair 907 and conveys the sheet to the finisher 100.

The finisher 100 sequentially takes in the sheets discharged from the copying machine main body 602, and aligns and bundles into one bundle the plurality of sheets that have been taken in. Further, the finisher 100 punches hole near a trailing edge of each of the sheets that have been taken in. Furthermore, the finisher 100 performs processing such as stapling the trailing edge of the sheet bundle, i.e., stapling processing, and bookbinding processing. More specifically, the finisher 100 includes a stapling unit 100A which staples the sheets, and a saddle-stitching unit 135 which folds the sheet bundle into two and performs bookbinding.

Figure 2:
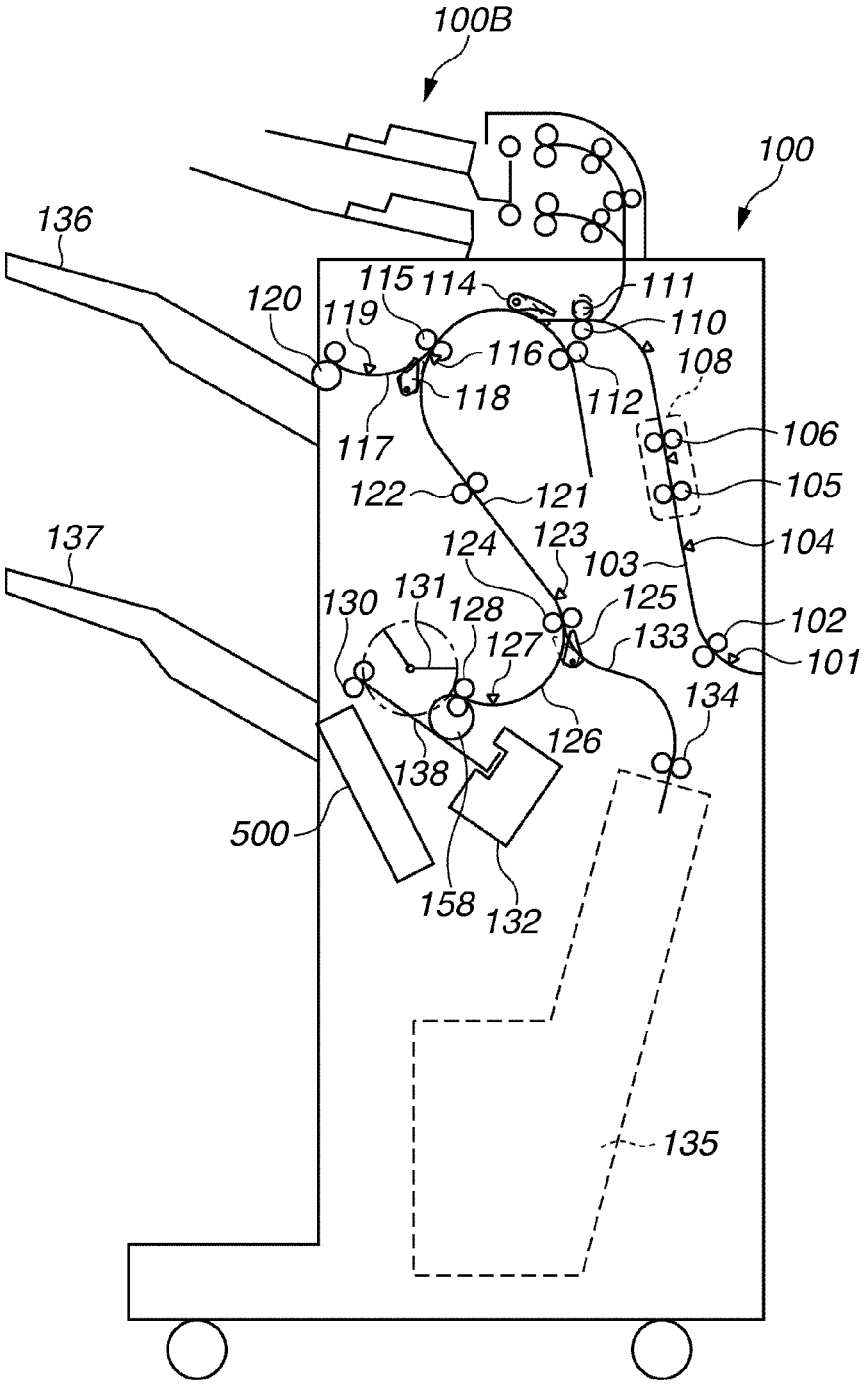
FIG. 2 illustrates a configuration of a finisher which is the sheet processing apparatus illustrated in FIG. 1.

Referring to FIG. 2, the finisher 100 includes an inlet roller pair 102 for taking the sheets therein. When the sheet discharged from the copying machine main body 602 is transferred to the inlet roller pair 102, an inlet sensor 101 detects transfer timing of the sheet.

While the sheet conveyed from the inlet roller pair 102 passes through a conveyance path 103, a lateral registration detection sensor 104 detects edge positions of the sheet. The lateral registration detection sensor 104 thus detects an amount of displacement of the sheet in a width direction with respect to a center position of the finisher 100. If the lateral registration detection sensor 104 detects such a displacement of the sheet in the width direction (hereinafter referred to as a lateral registration error), a shift unit 108 moves the sheet in a front direction or a back direction by a predetermined amount while the sheet is being conveyed by shift roller pairs 105 and 106. The shift unit 108 thus shifts the sheet. More specifically, "front" indicates, when the user is standing towards the operation unit 601 illustrated in FIG. 1, a front surface side of the apparatus, and "back" indicates a back surface side of the apparatus.

A conveyance roller 110 and a release roller 111 then convey the sheet to a buffer roller pair 115. If the finisher 100 is to discharge the sheet to an upper tray 136, a driving unit (not illustrated) such as a solenoid causes an upper path switching member 118 to enter a state as indicated by a broken line illustrated in FIG. 2. As a result, the sheet is guided to an upper path conveyance path 117 and discharged from an upper discharge roller 120 to the upper tray 136. If the sheet is not to be discharged to the upper tray 136, the upper path switching member 118 in a state as indicated by a solid line illustrated in FIG. 2 guides the sheet conveyed from the buffer roller pair 115 to a bundle conveyance path 121. A conveyance roller 122 and a bundle conveyance roller pair 124 then convey the sheet to sequentially pass through the conveyance path.

If the finisher 100 is to discharge the conveyed sheet to a lower stacking tray 137, a saddle-stitching path switching member 125 in a state indicated by the solid line illustrated in FIG. 2 conveys the sheet to a lower path 126. A lower discharge roller pair 128, i.e., a sheet conveyance unit, then sequentially conveys the sheet to an intermediate stacking tray 138. A returning unit, such as a paddle 131 or a belt roller 158, sequentially stacks and aligns the conveyed sheets. The paddle 131 and the belt roller 158 thus align a predetermined number of sheets on the intermediate stacking tray 138, i.e., a sheet processing portion for performing processing on the aligned and stacked sheet bundle.

A stapler 132, i.e., a stapling unit, staples as necessary the sheet bundle which has been aligned on the intermediate stacking tray 138. A bundle discharge roller pair 130 then discharges the sheet bundle to the stacking tray 137, i.e., a lower discharged sheet stacking portion.

The stapler 132, i.e., the stapling unit (processing unit), is freely movable in the width direction (hereinafter referred to a depth direction) perpendicular to a sheet conveyance direction. The stapler 132 can thus staple at a plurality of positions in the trailing edge of the sheet bundle. Further, the stapler 132 staples the edge portion of the sheet bundle using a clinch motor M132 illustrated in FIG. 14 to be described below, and is fixed to a slide supporter 305 illustrated in FIG. 3.

On the other hand, if the finisher 100 is to perform saddle-stitching processing on the sheets, the driving unit (not illustrated) such as the solenoid moves the saddle-stitching path switching member 125 to the position indicated by the broken line illustrated in FIG. 2. As a result, the sheet is conveyed to a saddle-stitching path 133, and a saddle-stitching inlet roller pair 134 guides the sheet to a saddle-stitching unit 135 which performs saddle-stitching processing on the sheet.

Further, an inserter 100B is disposed on the upper portion of the finisher 100 as illustrated in FIG. 2. The inserter 100B is used for inserting as a first page or a final page of the sheet bundle, or between the sheets on which the copying machine main body 602 has formed the images, a sheet (i.e., an insert sheet) other than a normal sheet.

Figure 3:
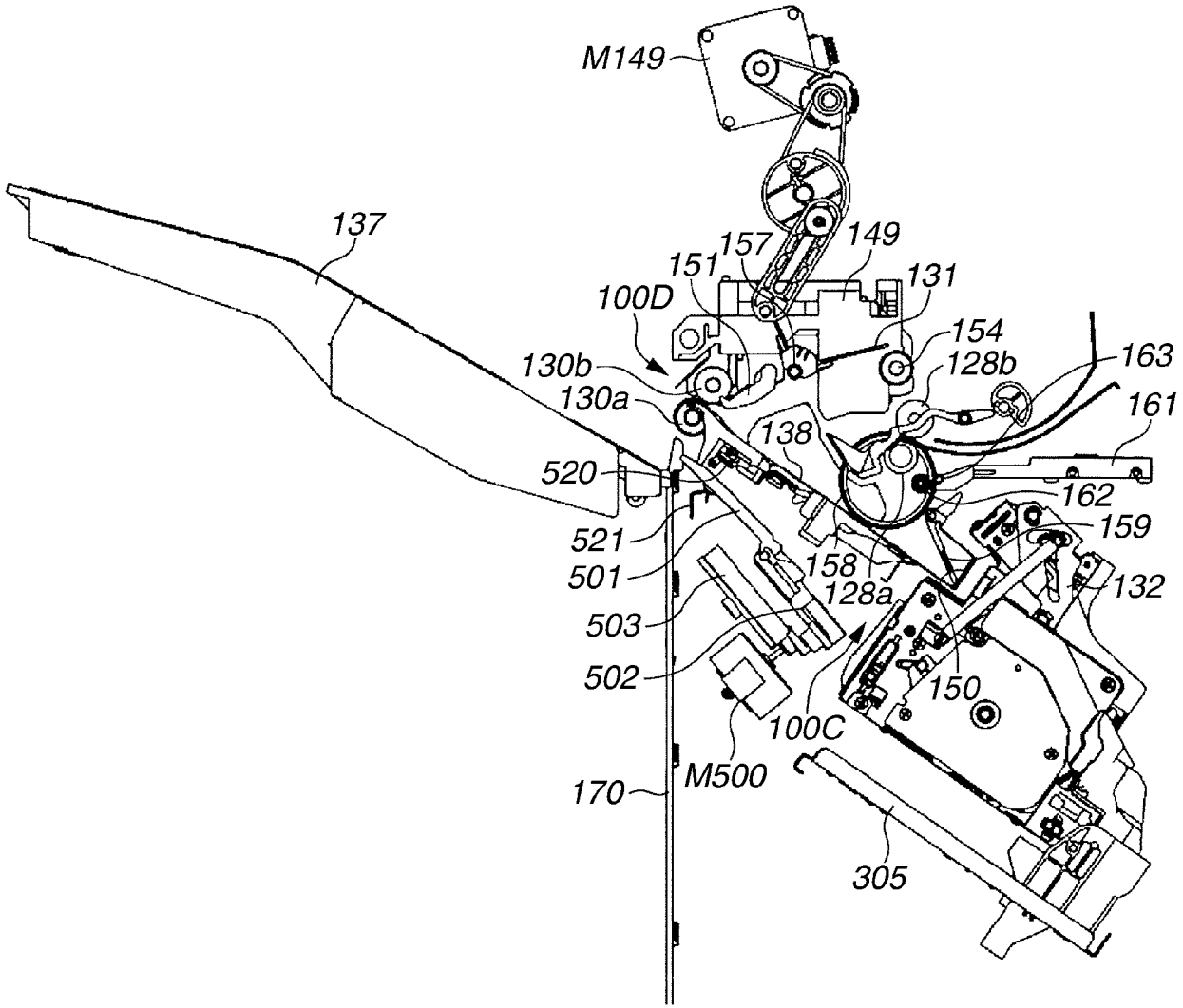
FIG. 3 illustrates a configuration of a stapling unit included in the finisher.

The stapling unit 100A which includes the intermediate stacking tray 138 will be described below. Referring to FIG. 3, the intermediate stacking tray 138 is disposed to be tilted from a downstream side in a sheet bundle discharging direction (i.e., a left side in FIG. 3) to the upstream side (i.e., a right side in FIG. 3). Further, a trailing edge stopper 150 is disposed at a lower edge of the intermediate stacking tray 138, i.e., the upstream side. The intermediate stacking tray 138 may be horizontally disposed.

Figure 4:
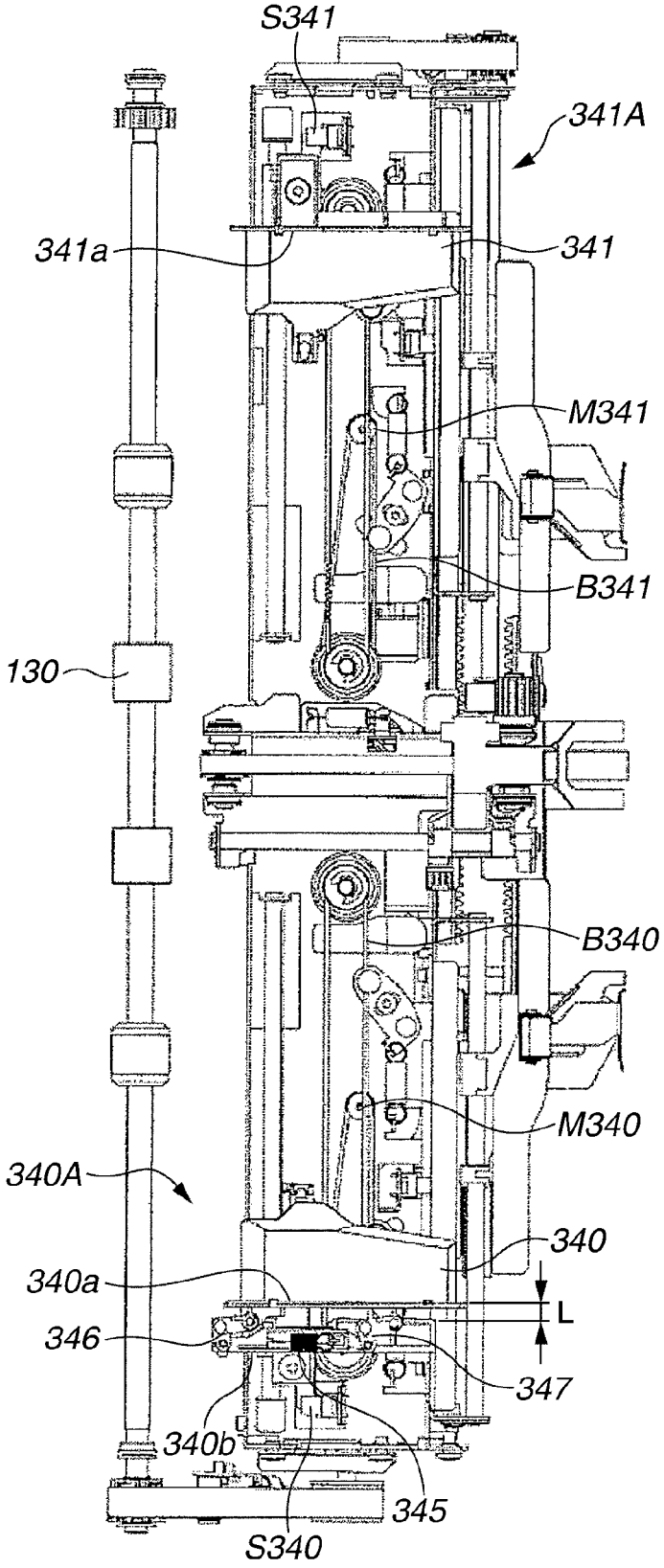
FIG. 4 illustrates a configuration of an intermediate stacking tray included in the stapling unit.

Referring to FIG. 4, the intermediate stacking tray 138 includes, in an intermediate portion, front and back alignment units 340A and 341A. In other words, lateral edge regulating members, which are width direction alignment members for regulating (aligning) both lateral edge positions in the width direction of the sheets conveyed to the intermediate stacking tray 138, are disposed in the intermediate stacking tray 138. The front and back alignment units 340A and 341A include front and back alignment plates 340 and 341 which are alignment members having alignment units 340*a* and 341*a* that configure alignment walls. Further, the front and back alignment units 340A and 341A include front and back alignment plate motors M340 and M341 which independently drive each of the front and back alignment units 340A and 341A respectively.

When the finisher 100 regulates both lateral edge positions of the sheets, the front and back alignment units 340A and 341A transmit drive forces of the front and back alignment plate motors M340 and M341 to the front and back alignment plates 340 and 341 via timing belts B340 and B341. The timing belts B340 and B341 configure a moving unit along with the front and back alignment plate motors M340 and M341. As a result, the front and back alignment plates 340 and 341 which come into contact with and separate from the sheet independently move along the width direction with respect to the intermediate stacking tray 138. The front and back alignment plates 340 and 341 thus come into contact with both lateral ends of the sheets stacked on the intermediate stacking tray 138 and align the sheets.

In other words, the front and back alignment plates 340 and 341 are disposed in the intermediate stacking tray 138 so that the alignment units (i.e., alignment walls) 340*a* and 341*a* are facing each other. Further, the front and back alignment plates 340 and 341 are assembled to be movable in forward and reverse directions with respect to the alignment direction. As a result, the front and back alignment plates 340 and 341 align the positions of the sheets on the intermediate stacking tray 138 even when the sheet (or the sheet bundle) is conveyed by being shifted in the width direction.

One of the alignment plates, e.g., the alignment unit 340*a* configuring the alignment wall of the front alignment plate 340, is disposed to be movable in the width direction. Further, a tension spring 345 is disposed between the alignment unit 340*a* and a main body 340*b* of the front alignment plate 340. The tension spring 345 and moving links 346 and 347 cause the alignment unit 340*a* to project towards the sheet by a predetermined amount L. If the alignment unit 340*a* presses against the sheet when regulating the lateral edge position of the sheet, the alignment unit 340*a*, i.e., a pressing unit, moves towards the main body, resisting the tension spring 345.

Figure 5:
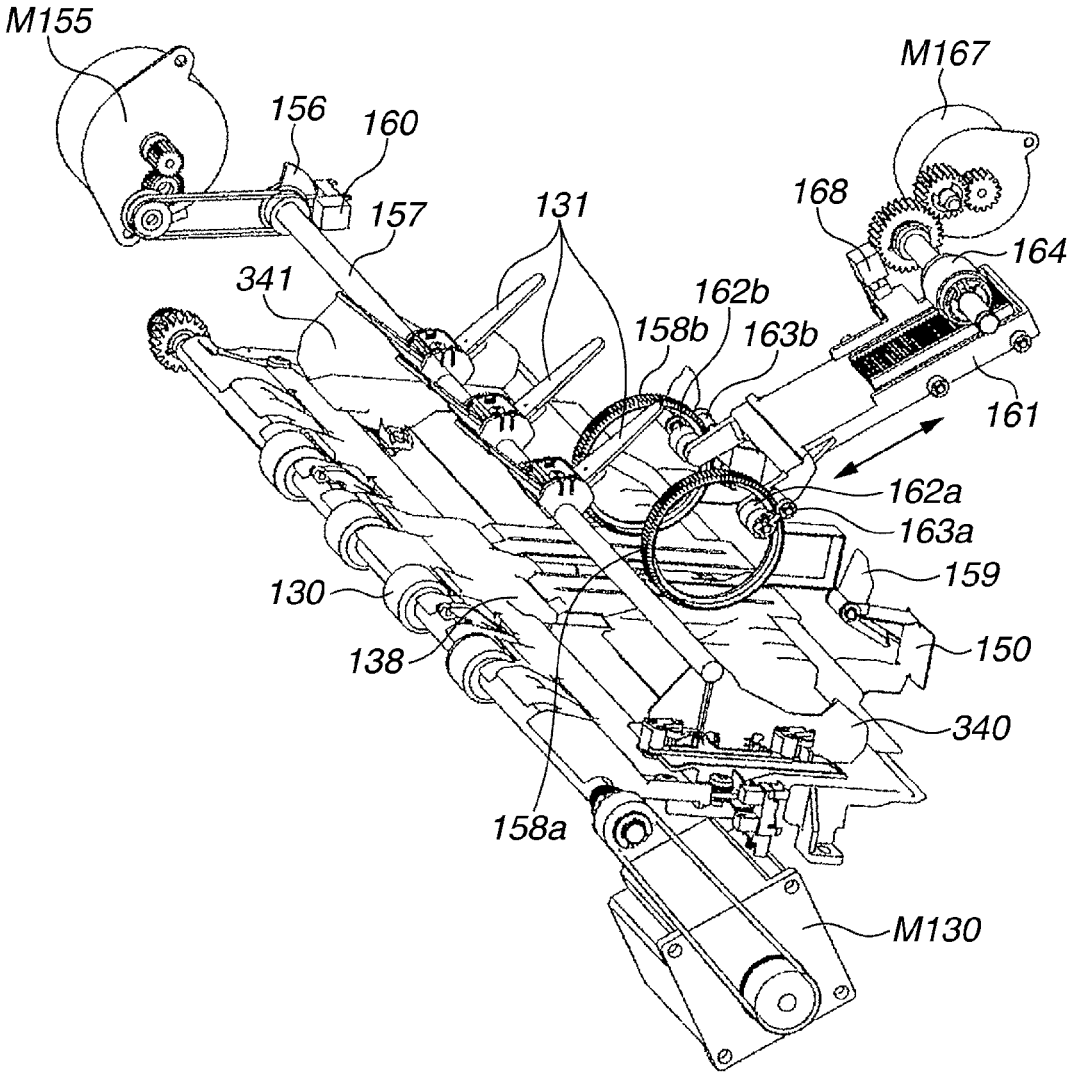
FIG. 5 illustrates a configuration of a sheet trailing edge alignment unit included in the stapling unit.

Further, referring to FIG. 3, the pull-in paddle 131 and an open/close guide 149 are disposed in the upper edge, i.e., the downstream side in a pull-in direction, of the intermediate stacking tray 138. Referring to FIG. 5, a plurality of the pull-in paddles 131 is disposed in the upper portion of the intermediate stacking tray 138, and is fixed along a rotating drive shaft 157 which is rotated by a paddle drive motor M155. The paddle drive motor M155 thus rotates at appropriate timing the pull-in paddles 131 in an anti-clockwise direction as illustrated in FIG. 3.

Referring to FIG. 3, the stapling unit 100A includes a sheet trailing edge alignment unit 100C and a discharge port 100D. The sheet trailing edge alignment unit 100C is a conveyance direction alignment unit that aligns the position of the sheet in the conveyance direction. Referring to FIG. 5, the sheet trailing edge alignment unit 100C includes the belt roller 158 (158*a* and 158*b*, i.e., a rotatable member), a trailing edge lever 159, and the trailing edge stopper 150. The trailing edge stopper 150 is a regulating member which comes into contact with the edge of the sheet in the upstream side in the conveyance direction. The pull-in paddles 131 and the belt roller 158 rotating in the anti-clockwise direction convey the sheet which has been conveyed to the intermediate stacking tray 138, and the trailing edge lever 159 then guides the sheet, so that the edge of the sheet in the upstream side in the conveyance direction comes into contact with the trailing edge stopper 150. The position of the sheet in the conveyance direction is thus aligned.

The belt roller 158, i.e., an endless belt, is disposed above the intermediate stacking tray 138 to be vertically movable. Further, the belt roller 158 is wound around an outer periphery of a first discharge roller 128*a* (refer to FIG. 3) configuring the first discharge roller pair 128. Furthermore, the belt roller 158 is held between a pinch roller A 162 (i.e., 162*a* and 162*b*) and a pinch roller B 163 (i.e., 163*a* and 163*b*) disposed at the leading edge of a belt driving member 161. According to the present exemplary embodiment, an elevating unit which elevates the belt roller 158 includes the belt driving member 161 and the pinch roller A 162.

The lower portion of the belt roller 158 held between the pinch roller A 162 and the pinch roller B 163 is positioned to be in contact with the top sheet stacked on the intermediate stacking tray 138. The belt roller 158 then rotates in the anti-clockwise direction, driven by the rotation of the first discharge roller 128*a*. As a result, the sheet conveyed to the intermediate stacking tray 138 is conveyed in the direction opposite to the conveyance direction, and comes into contact with the trailing edge stopper 150.

Further, a belt drive motor M167 moves the belt driving member 161 via a lack gear 164 in the direction indicated by an arrow illustrated in FIG. 5, so that the shape of the belt roller 158 can be elastically changed. The position at which the belt roller 158 is in contact with the top sheet can thus be moved upwards and downwards. A belt driving home sensor S168 detects the edge of the belt driving member 161 for controlling the position of the belt driving member 161.

The open/close guide 149 illustrated in FIG. 3 is supported by a supporting shaft 154 to be able to rotate about the supporting shaft 154, and is disposed as an upper conveyance guide in a position opposite to the intermediate stacking tray 138. The open/close guide 149 rotatably holds an upper bundle discharge roller 130*b* configuring the bundle discharge roller pair 130 along with a lower bundle discharge roller 130*a* disposed at the edge of the intermediate stacking tray 138 in the downstream side.

The open/close guide 149 holds the upper bundle discharge roller 130*b* to freely contact and separate from the lower bundle discharge roller 130*a*. More specifically, the upper bundle discharge roller 130*b* contacts and separates from the lower bundle discharge roller 130*a* along with swinging of the open/close guide 149. Normally, when the sheet is conveyed to the intermediate stacking tray 138, the open/close guide 149 swings upwards, so that the upper bundle discharge roller 130*b* becomes separated from the lower portion discharge roller 130*a*, i.e., the other roller in the bundle discharge roller pair 130. The bundle discharge roller pair 130 thus becomes an open state.

Further, when the sheet has been processed on the intermediate stacking tray 138, the open/close guide 149 swings downwards due to rotation of an open/close motor M149. The upper bundle discharge roller 130*b* and the lower bundle discharge roller 130*a* thus nip the sheet bundle. A bundle discharge drive motor M130 (refer to FIG. 14) then rotates the bundle discharge roller pair 130 (e.g., the lower bundle discharge roller 130*a*) in forward and reverse directions. The bundle discharge roller pair 130 is thus rotated while the upper bundle discharge roller 130*b* and the lower bundle discharge roller 130*a* nip the sheet bundle, so that the sheet bundle is discharged from the discharge port 100D to the lower stacking tray 137.

The stacking tray 137 is tilted so that the downstream side in the discharging direction of the stacking tray 137 is high. As a result, if the sheet bundle is discharged to the stacking tray 137, the edge of the sheet bundle in the upstream side in the discharging direction comes into contact with a stacking wall 170 due to tilting of the stacking tray 137. The stacking wall 170 is a regulating member disposed below the discharge port 100D. The edge position of the sheet bundle in the upstream side in the discharging direction is thus regulated.

When the sheet to be processed is conveyed to the intermediate stacking tray 138, the open/close guide 149 swings upwards. As a result, the sheet conveyed from the lower discharge roller pair 128 slides down on a stacking surface of the intermediate stacking tray 138 or on the sheet stacked on the intermediate stacking tray 138. The sheet slides down due to tilting of the intermediate stacking tray 138 and the operation of the pull-in paddle 131.

The sheet which has slid down is conveyed (moved) by rotation of the belt roller 158, i.e., the sheet conveyance unit, in the anti-clockwise direction, and guided by the trailing edge lever 159. The trailing edge (i.e., the edge in the upstream side in the conveyance direction) of the sheet then comes into contact with the trailing edge stopper 150, so that the sheet stops moving. Further, a guide 151 which guides the sheet to a roller nip portion of the upper bundle discharge roller 130*b* is disposed upstream with respect to the upper bundle discharge roller 130*b* in the open/close guide 149.

Figure 6:
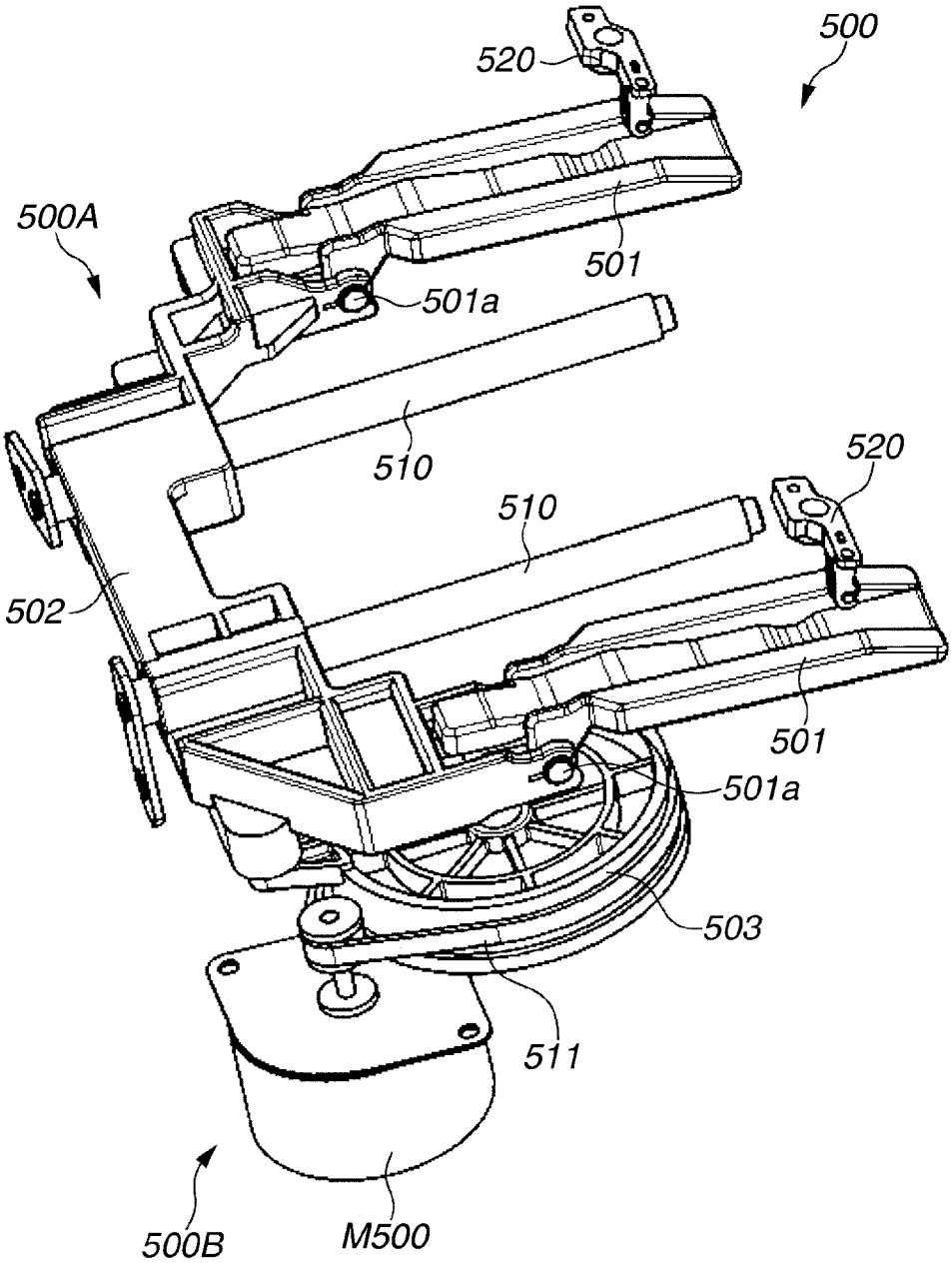
FIG. 6 illustrates a configuration of a supporting tray unit included in the stapling unit.

According to the present exemplary embodiment, a supporting tray unit 500 is disposed below the intermediate stacking tray 138 as illustrated in FIGS. 2 and 3. Referring to FIG. 6, the supporting tray unit 500 includes a supporting tray 500A, i.e., a sheet supporting unit having a predetermined thickness. The supporting tray 500A includes a supporting tray base 502, and a movable guide 501 which freely appears above the stacking tray 137. The movable guide 501 is supported on the supporting tray base 502 to freely rotate about a shaft 501*a* as a fulcrum. Further, two movable guides 501 are disposed at different positions in a sheet width direction, and the movable guides 501 rotate by self-weight.

The supporting tray base 502, i.e., a linearly moving slide member, is movable along a slide shaft 510, and includes a rotation stopper (not illustrated) which limits a movable range of the movable guide 501. As a result, if there are no other members that regulate rotating, the movable guide 501, i.e., a movable guide member, remains in a downward-rotating orientation (hereinafter referred to as a self-weight orientation) until regulated by the rotation stopper in the supporting tray base 502.

Figure 7A:
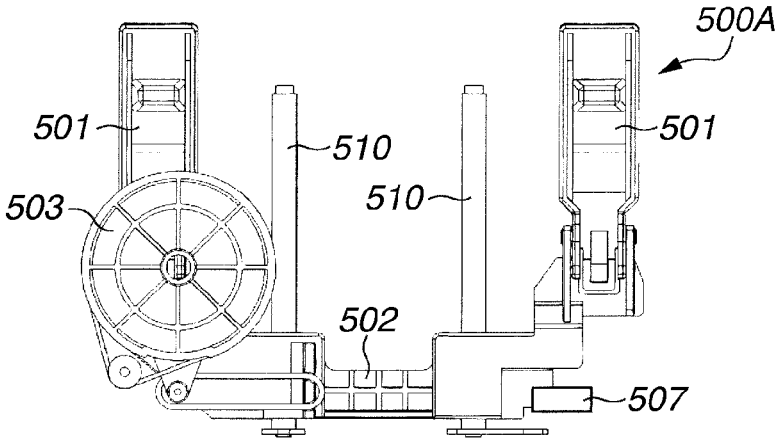
FIGS. 7A, 7B, and 7C illustrate operations of the supporting tray unit.
Figure 7B:
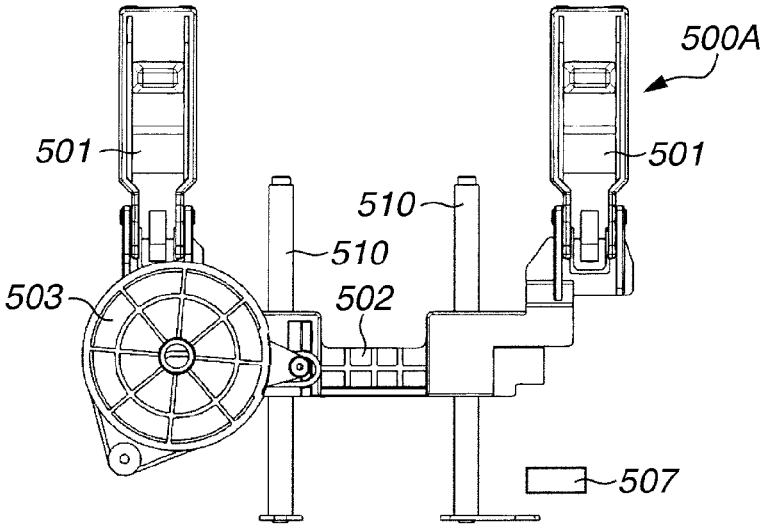
Figure 7C:
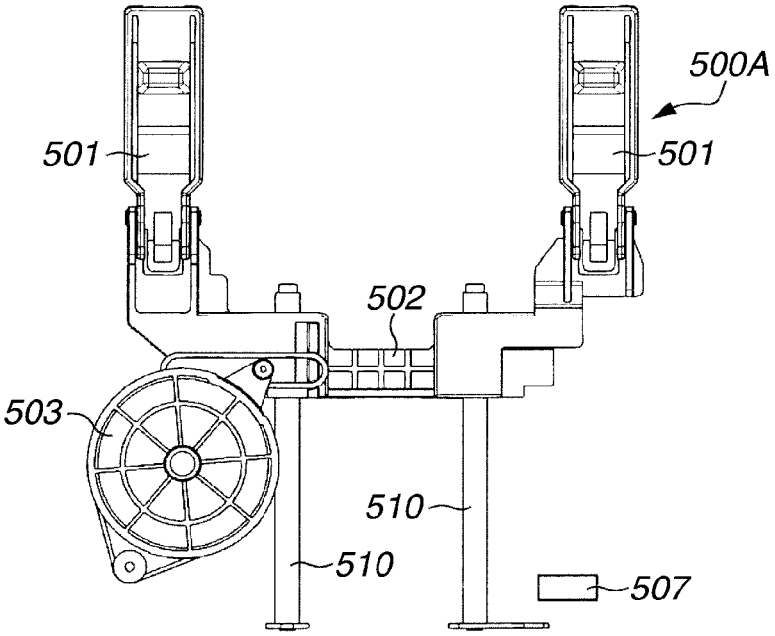

Further, the supporting tray unit 500 includes a supporting tray drive motor M500 capable of rotating in the forward and reverse directions, and which moves (the supporting tray base 502 in) the supporting tray 500A along the slide shaft 510. The driving force of the supporting tray drive motor M500 is transferred to a rotating link 503 via a belt 511 and rotates the rotating link 503. The supporting tray base 502 thus moves along the slide shaft 510 as illustrated in FIGS. 7A, 7B, and 7C, by the rotation of the rotating link 503. In other words, according to the present exemplary embodiment, the supporting tray drive motor M500 and the rotating link 503 configure a moving unit 500B illustrated in FIG. 6, which moves the supporting tray 500A.

FIG. 7A illustrates a state where (the entire movable guide 501 in) the supporting tray 500A is in a retracted position, in which the supporting tray 500A becomes contained inside the finisher 100. FIG. 7B illustrates a state where the supporting tray 500A has moved to a staple sorting position to be described below. FIG. 7C illustrates a state where (the movable guide 501 in) the supporting tray 500A has moved to a projecting position by projecting above the stacking tray 137 to support the sheet from below. Referring to FIGS. 7A, 7B, and 7C, a supporting tray home sensor 507 detects a home position of the supporting tray 500A. The supporting tray home sensor 507 is disposed in the vicinity of the upstream side in the movable range of the supporting tray base 502.

Referring to FIG. 3, each of orientation retaining members 520 and 521 is disposed proximately below the bundle discharge roller 130, and above and below the movable guide 501 respectively. The orientation retaining members 520 and 521 change the orientation of the movable guide 501 along with the movement of the supporting tray base 502. A relation between the movement of the supporting tray base 502 and a change in the orientation of the movable guide 501, and the effect of the change in the orientation of the movable guide 501 will be described below.

The operations of the supporting tray 500A according to the present invention will be described below with reference to FIGS. 8A, 8B, 8C, 9A, 9B, and 9C.

Figure 8A:
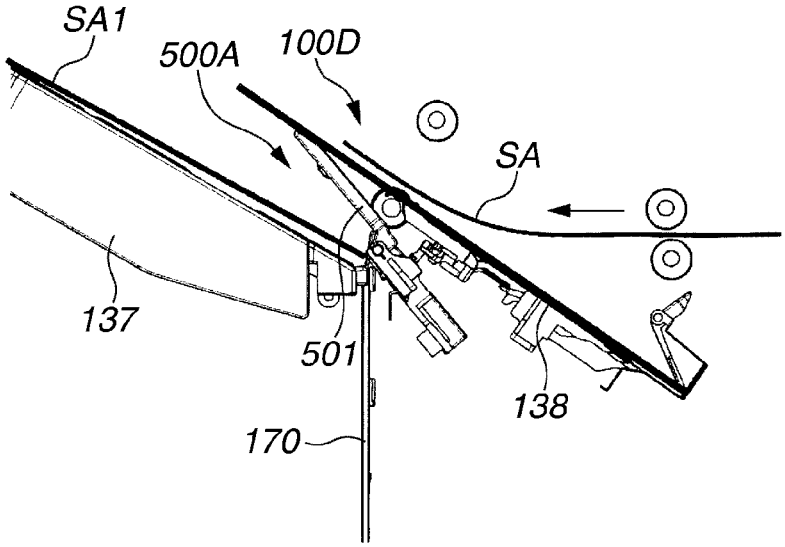
FIGS. 8A, 8B, and 8C illustrate operations of a supporting tray included in the supporting tray unit.

Referring to FIG. 8A, when the finisher 100 stacks the sheets on the intermediate stacking tray 138 for performing processing on the sheets, such as stapling, the supporting tray 500A moves to the projecting position, i.e., projects above the stacking tray 137. If the finisher 100 then stacks the sheet S to be processed, the supporting tray 500A can hold the sheet S whose length in the discharging direction is long so that the sheet S runs off the intermediate stacking tray 138. In such a case, the downward rotation of the movable guide 501 is regulated in the projecting position. The movable guide 501 along with the intermediate stacking tray 138 thus maintains the orientation for stacking the sheet S, so that the sheet S is prevented from falling off from the intermediate stacking tray 138.

Figure 8B:
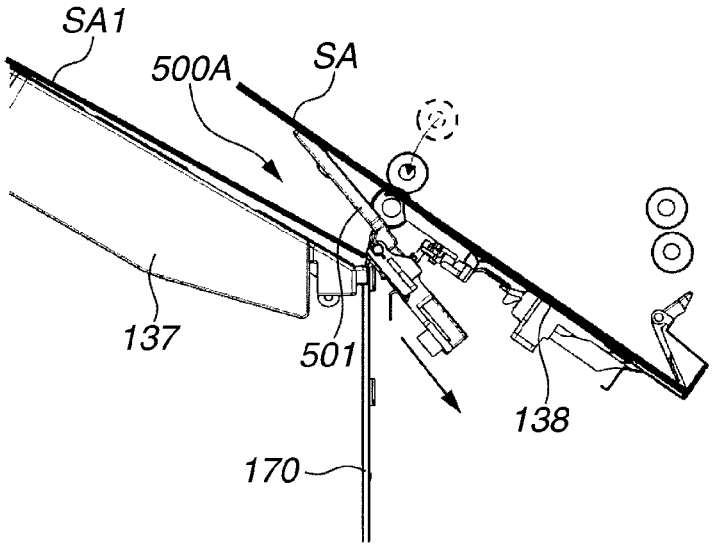
Figure 8C:
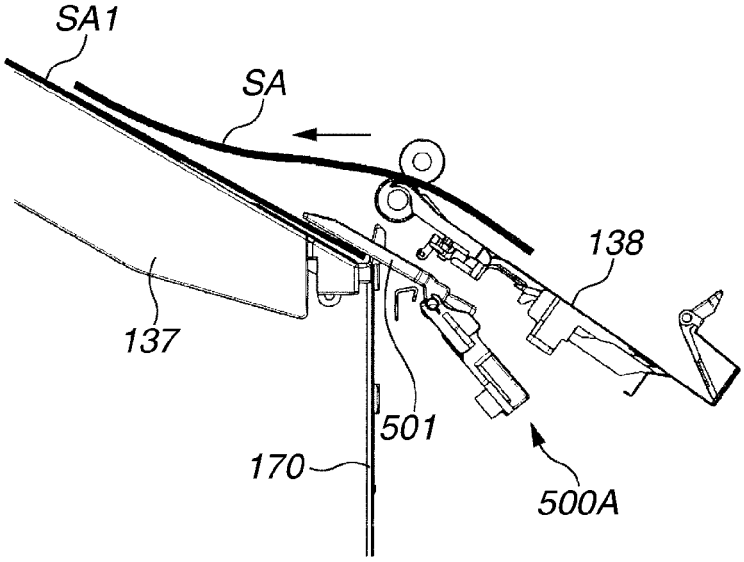
Figure 9A:
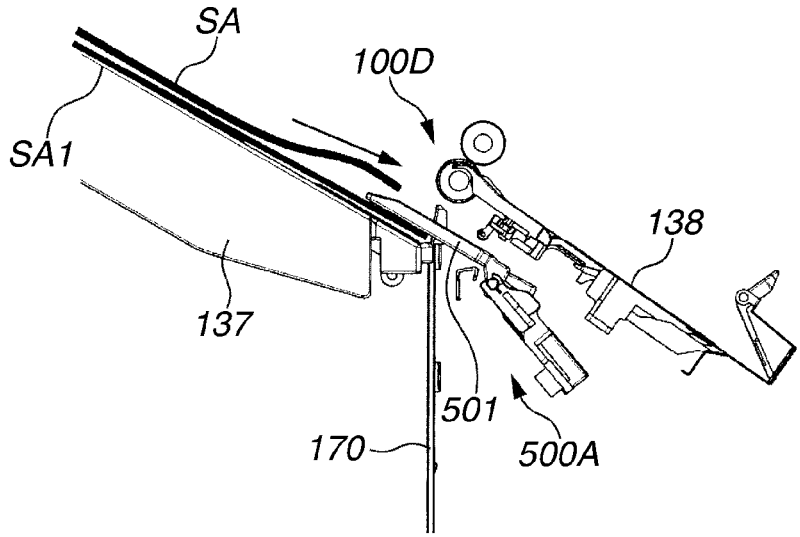
FIGS. 9A, 9B, and 9C illustrate operations of the supporting tray.

When the finisher 100 is to perform stapling on the sheets, the supporting tray 500A moves in the direction of the arrow illustrated in FIG. 8B. As a result, a regulated position of the movable guide 501 in the projecting position changes, and the movable guide 501 starts to rotate downwards. The supporting tray 500A then moves to the staple sorting position, i.e., a first position, which is closer to the stacking tray 137 (i.e., a sheet stacking portion) as compared to the projecting position. This is as illustrated in FIG. 8C. The supporting tray 500A moves to the staple sorting position before the stapled sheet bundle SA is discharged from the discharging port 100D. The stapled sheet bundle SA is then discharged to the stacking tray 137, and the edge of the stapled sheet bundle SA in the upstream side in the discharging direction (hereinafter referred to a trailing edge) is mounted on the leading edge of the movable guide 501 that is in the staple sorting position as illustrated in FIG. 9A.

Figure 10A:
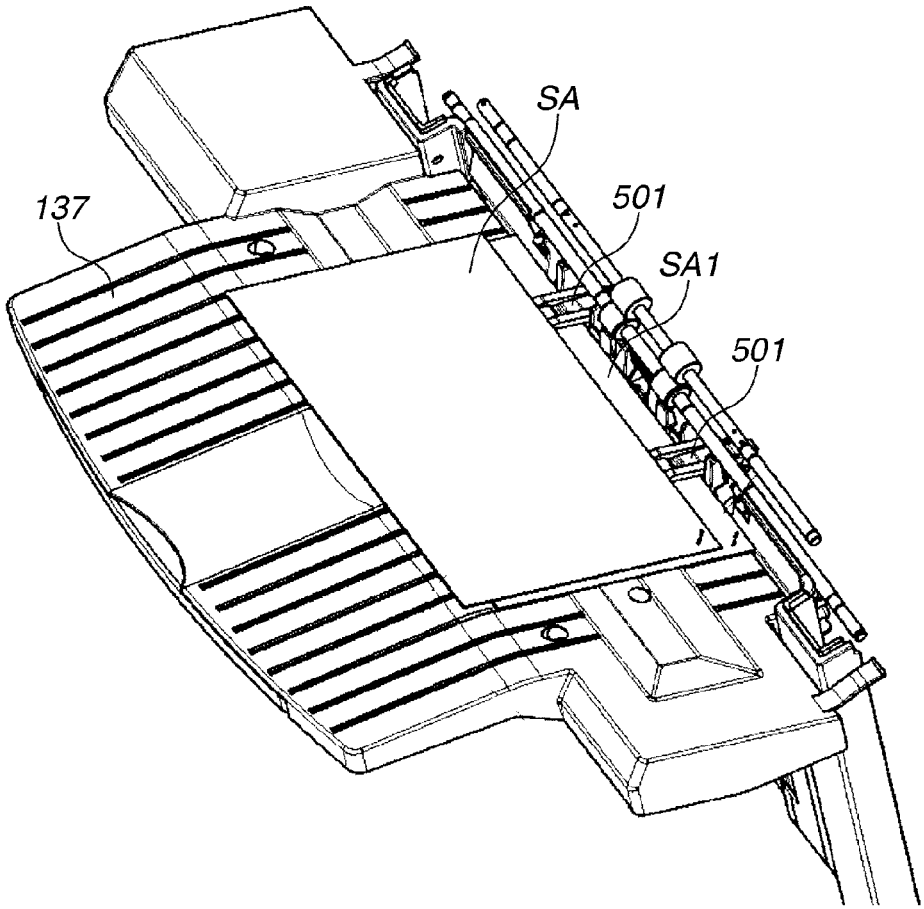
FIGS. 10A and 10B illustrate a positional relation between a stapled sheet bundle and a movable guide when the stapled sheet bundle is mounted on a leading edge of a movable guide.
Figure 10B:
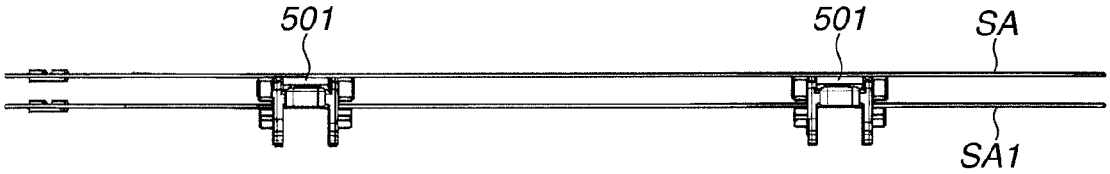

FIGS. 10A and 10B illustrate a positional relation between the stapled sheet bundles SA and SA1 stacked on the stacking tray 137 and the supporting tray 500A in the above-described case. More specifically, FIG. 10A is a perspective view illustrating the stacking tray 137, the supporting tray 500A, and the stapled sheet bundles SA and SA1. FIG. 10B illustrates the positional relation viewed from a direction of the discharge roller. Referring to FIGS. 10A and 10B, the trailing edge of the stapled sheet bundle SA is mounted on the leading edge of the movable guide 501 in the staple sorting position. The stapled sheet bundle SA thus becomes positioned above the stapled portion in the stapled sheet bundle SA1 previously discharged on the stacking tray 137. If the supporting tray 500A is positioned in the range where the stapled sheet bundle SA can retain the orientation by a body thereof, it is not necessary for the supporting tray 500A to support the sheet bundle SA at the position of covering the stapled portion in the stapled sheet bundle SA1 previously discharged on the stacking tray 137.

Figure 9B:
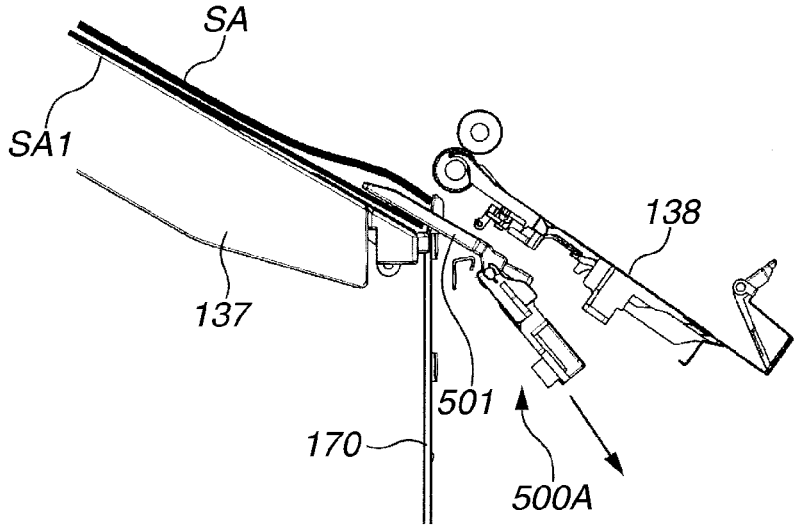
Figure 9C:
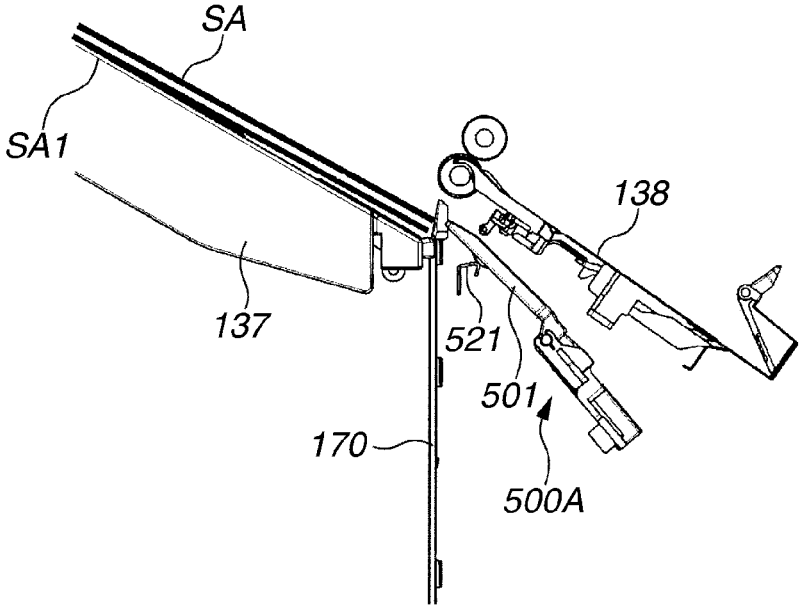

The discharged sheet then moves due to the tilt of the stacking tray 137 and the self-weight, and is guided by the supporting tray 500A, so that the edge of the discharged sheet in the upstream side in the discharging direction (hereinafter referred to as a trailing edge) contacts the stacking wall 170 positioned below the discharge port 100D. This is as illustrated in FIG. 9B. In such a case, the discharged stapled sheet bundle SA moves over the upper surface of the supporting tray 500A, so that the stapled sheet bundle SA reaches the stacking wall 170 without getting caught by the stapled portion of the previously stacked stapled sheet bundle SA1. The supporting tray 500A is then moved to the retracted position, i.e., a second position in which the supporting tray 500A stops supporting the discharged sheet bundle, as illustrated in FIG. 9C. The supporting tray 500A is moved to the retracted position at predetermined timing, e.g., at the timing of the trailing edge of the discharged sheet reaching the stacking wall 170.

As a result, the supporting tray 500A is pulled out from between the sheet bundle SA and the previously stacked stapled sheet bundle SA1, and the discharged sheet bundle SA is stacked on the previously stacked stapled sheet bundle SA1. It is not necessary for the supporting tray 500A to start moving to the retracted position after the sheet bundle SA has reached the stacking wall 170. If a retracting speed of the supporting tray 500A is not excessively high, the supporting tray 500A may start retracting after the sheet bundle SA has dropped onto the supporting tray 500A in the staple sorting position.

The supporting tray 500A is retracted at an appropriate speed while the sheet is on the supporting tray 500A, so that the sheet bundle SA on the supporting tray 500A is pulled in at the same time. A pulling force is thus added to a returning force due to the self-weight, so that the sheet bundle SA comes into contact with the stacking wall 170. Further, the supporting tray 500A continues to move towards the retracted position even after the trailing edge of the sheet bundle SA reaches the stacking wall 170. The supporting tray is thus capable of transferring the sheet bundle SA to the stacking tray 137 while the trailing edge of the sheet bundle SA is in contact with the stacking wall 170.

As described above, the supporting tray 500A is capable of moving to three positions, i.e., the projecting position illustrated in FIG. 8A, the staple sorting position illustrated in FIG. 9A, and the retracted position in which the entire supporting tray 500A becomes stored in the apparatus as illustrated in FIG. 9C. Further, the projecting position illustrated in FIG. 8A corresponds to the position illustrated in FIG. 7C, the staple sorting position illustrated in FIG. 9B corresponds to the position illustrated in FIG. 7B, and the retracted position illustrated in FIG. 9C corresponds to the position illustrated in FIG. 7A.

Since it is necessary for the supporting tray 500A to hold the sheet from under the intermediate stacking tray 138 at an extended position of the intermediate stacking tray 138, the supporting tray 500A projects at a sharper angle as compared to a tilt angle of the intermediate stacking tray 138. This is as illustrated in FIG. 8A. Further, the orientation of the supporting tray 500A in the projecting position is at a sharper angle as compared to the tilt angle of the intermediate stacking tray 138 for the same reason. If an operation angle of the supporting tray 500A is close to the tilt angle of the intermediate stacking tray 138, it becomes necessary to increase the length and the movable range of the supporting tray 500A, so that the size of the finisher 100 increases.

Figure 11A:
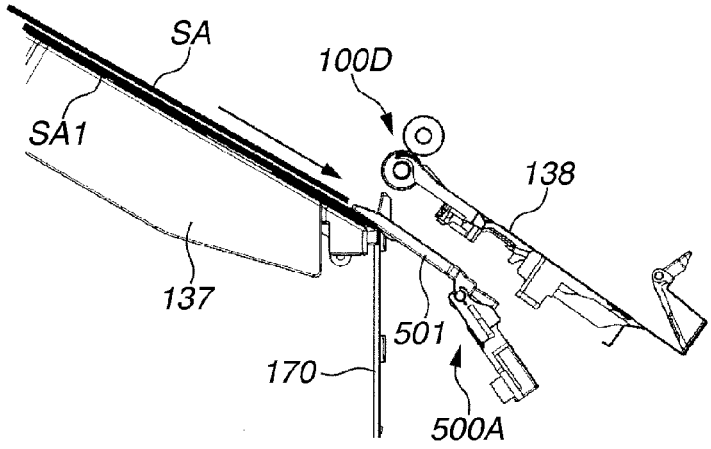
FIGS. 11A, 11B, and 11C illustrate angles of the movable guide.

On the other hand, the orientation of the supporting tray 500A in the staple sorting position illustrated in FIG. 8C is rotated and tilted in the direction towards the stacking tray 137, as compared to the orientation in the projecting position. Further, when the supporting tray 500A is to guide the discharged sheet at the staple sorting position, it is necessary for the leading edge of the supporting tray 500A to be in the downstream side of a point where the trailing edge of the discharged sheet falls. Further, it is desirable for a guide surface of the supporting tray 500A to be close to the surface of the stacking tray 137. More specifically, if the leading edge of the supporting tray 500A is positioned in the upstream side of the point where the discharged sheet falls, the trailing edge of the discharged sheet bundle SA may get caught at the leading edge of the supporting tray 500A as illustrated in FIG. 11A. In such a case, the supporting tray 500A may not perform the function thereof.

Figure 11B:
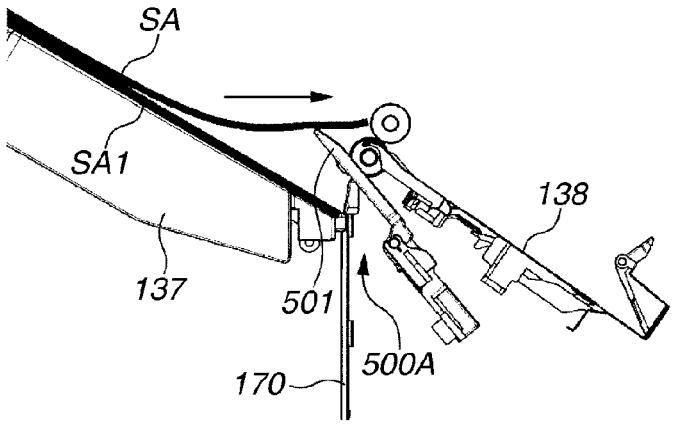

Furthermore, if the guide surface of the supporting tray 500A is excessively higher than the stacking tray 137, the discharge sheet bundle SA may move back as illustrated in FIG. 11B when the discharged sheet bundle SA moves towards the trailing edge, and may run into the discharge port 100D in the worst case. To prevent such a problem, the orientation of the supporting tray 500A in the staple sorting position is tilted towards the stacking tray 137 as compared to the orientation of the movable guide 501 in the projecting position.

Moreover, when the supporting tray 500A appears above the stacking tray 137 from the retracted position, the supporting tray 500A is orientated at minimum to appear above the trailing edge of the previously stacked sheet bundle. This is to prevent the leading edge of the supporting tray 500A from contacting the previously stacked sheet bundle SA1 and disrupting the stack. In other words, the orientation of the supporting tray 500A in the retracted position is upright in a direction to move away from the stacking tray 137, as compared to the orientation in the staple sorting position.

Figure 11C:
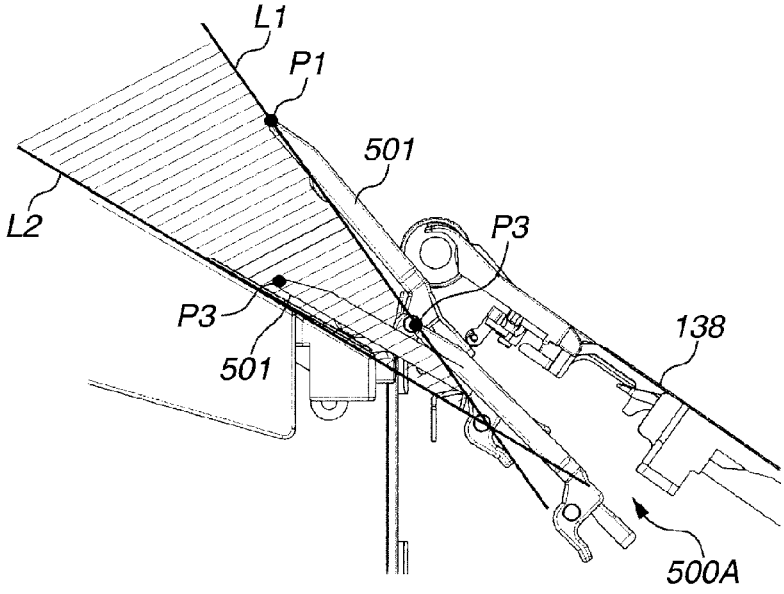

More specifically, according to the present exemplary embodiment, the orientation of the supporting tray 500A changes in the following three positions; the projecting position (i.e., a stacking position), the staple sorting position (i.e., the first position), and the retracted position (i.e., the second position). FIG. 11C illustrates the relation of the leading edge position of (the movable guide 501 in) the supporting tray 500A in the above-described three positions, as viewed from the finisher side.

Referring to FIG. 11C, P1 indicates the leading edge position i.e., the edge position in the upstream side in the discharging direction, of the movable guide 501 in the projecting position. P2 indicates the leading edge position of the movable guide 501 in the staple sorting position. P3 indicates the leading edge position of the movable guide 501 in the retracted position. Further, L1 is a straight line which passes through the two leading edge positions P1 and P3. The leading edge position P2 of the movable guide 501 in the staple sorting position is positioned in a shaded area between the straight line L1 and a straight line L2 which is formed by the stacking tray surface.

When the supporting tray 500A moves to the projecting position, the orientation retaining member 520 is positioned behind and above the movable guide 501 in the projecting position to regulate downward rotation of the movable guide 501. As a result, when the supporting tray 500A moves to the projecting position, the leading edge position P1 of the movable guide is maintained in the position illustrated in FIG. 11C.

Figure 12A:
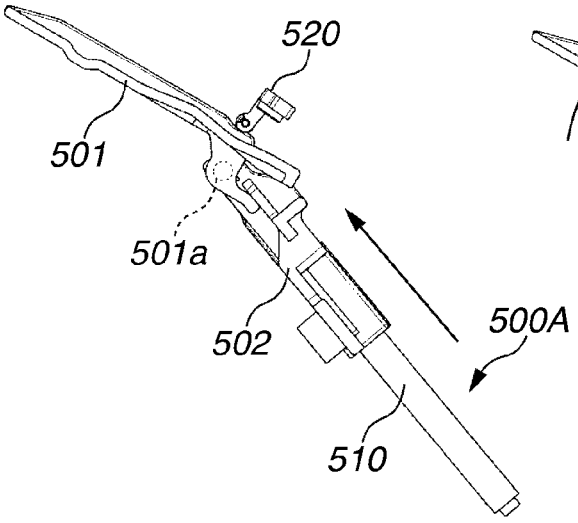
FIGS. 12A, 12B, 12C, and 12D illustrate rotational operations of the movable guide.

When the supporting tray 500A moves from the retracted position to the projecting position, the movable guide 501 is orientated by the self-weight. FIG. 12A illustrates the relation between the movable guide 501 and the orientation retaining member 520, i.e., the regulating member which regulates a rotation angle of the movable guide 501, in such a state. More specifically, the orientation retaining member 520 is positioned in the downstream side in a projecting direction with respect to the shaft 501*a* in the movable guide 501. When there is such a positional relation between the movable guide 501 and the orientation retaining member 520, the movable guide 501 tilts downwards.

Figure 12B:
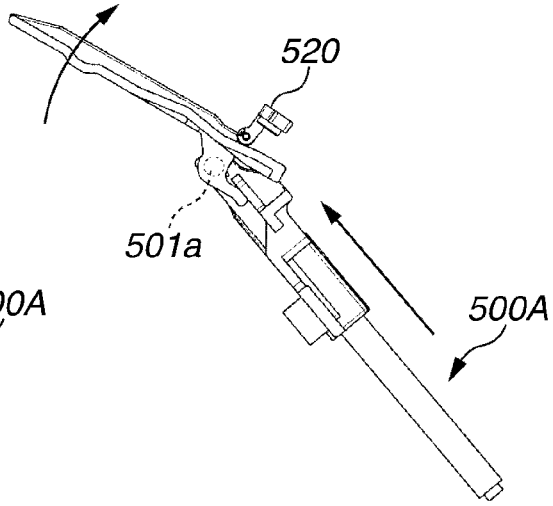
Figure 12C:
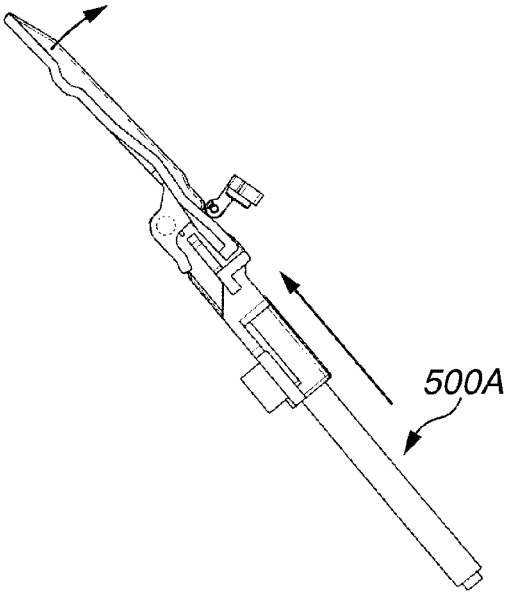
Figure 12D:
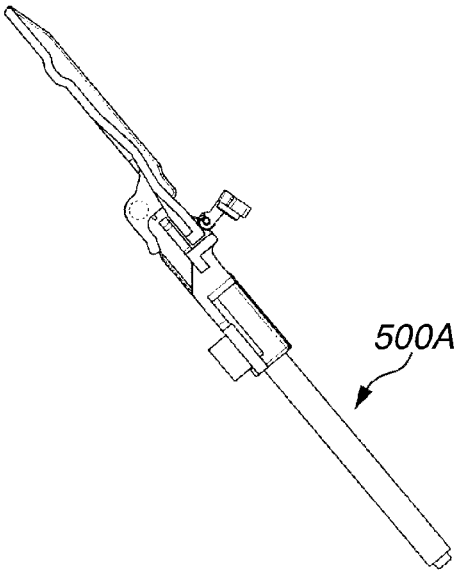

If the supporting tray base 502 then moves in the direction of the arrow illustrated in FIG. 12A in such a state, the position at which the orientation retaining member 520 is in contact with the movable guide 501 also moves. The orientation retaining member 520 thus comes into contact with the trailing edge of the movable guide 501 in the upstream side in the projecting direction with respect to the shaft 501*a*. As a result, the movable guide 501 rotates upwards as indicated by the arrows illustrated in FIGS. 12B and 12C, and the orientation of the movable guide 501 at the projecting position thus becomes as illustrated in FIG. 12D.

The movable guide 501 in the staple sorting position is orientated by the self-weight. Further, the previously stacked sheets on the stacking tray 137 may regulate the rotation of the movable guide 501 in the staple sorting position. Furthermore, when the supporting tray 500A moves to the retracted position, the orientation retaining member 521 illustrated in FIG. 3 is disposed below the leading edge of the movable guide 501. As a result, when the supporting tray 500A moves to the retracted position, the movable guide 501 is held from below by the orientation retaining member 521, so that rotating becomes regulated.

Figure 13:
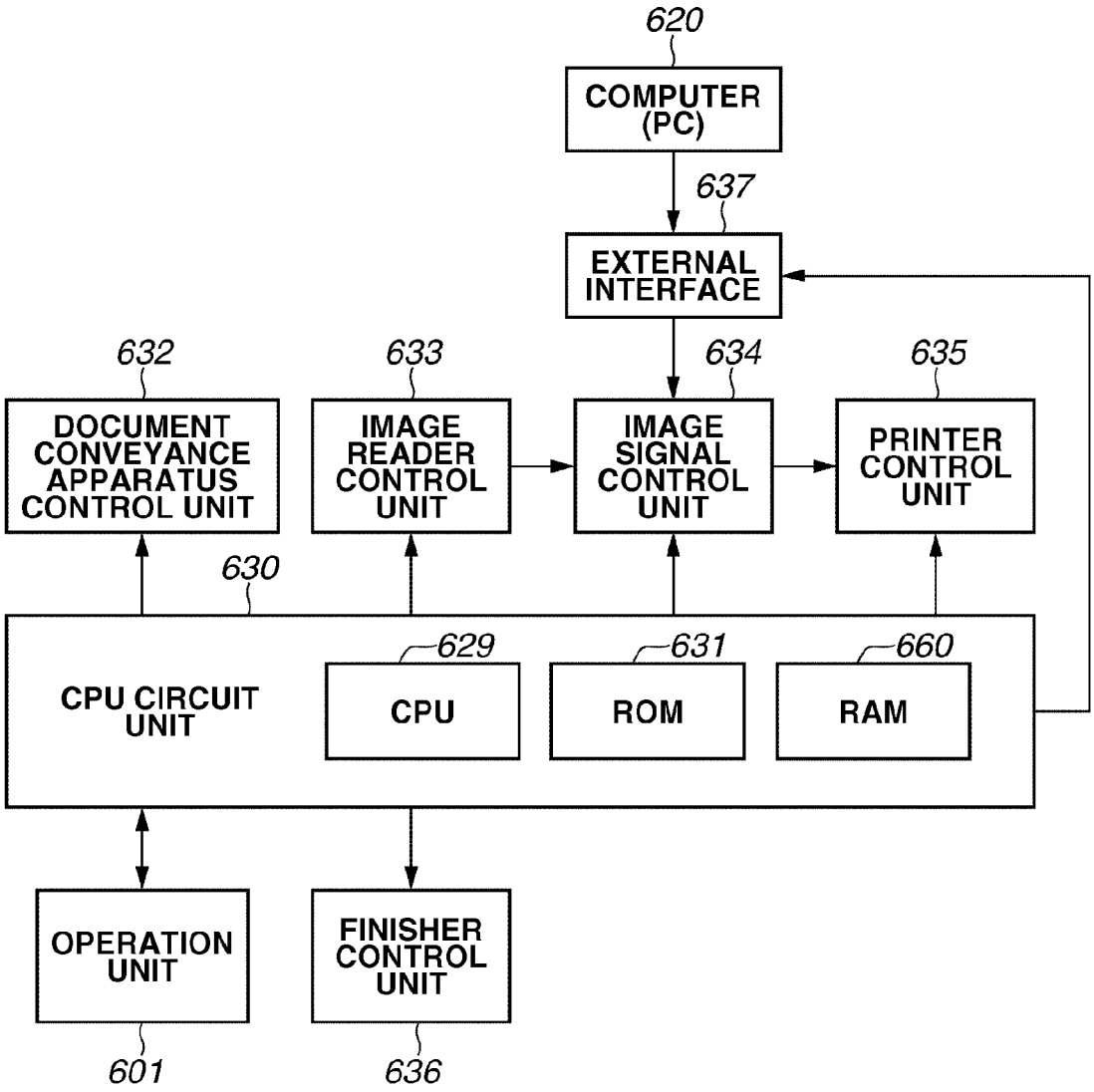
FIG. 13 is a control block diagram illustrating the monochrome/color copying machine.

FIG. 13 is a control block diagram illustrating the monochrome/color copying machine 600. Referring to FIG. 13, the CPU circuit unit 630 includes a CPU 629, a read-only memory (ROM) 631, and a random access memory (RAM) 660. The ROM 631 stores control programs. The RAM 660 is used as an area for temporarily storing control data and a work area for performing calculations related to performing control. An external interface 637 is an interface between the monochrome/color copying machine 600 and an external personal computer (PC, i.e., a computer) 620. When the external interface 637 receives print data from the external PC 620, the external interface 637 rasterizes the data to a bitmap image and outputs the bitmap image as image data to an image signal control unit 634.

The image signal control unit 634 then outputs the received data to a printer control unit 635, and the printer control unit 635 outputs the received data to an exposure control unit (not illustrated). Further, an image reader control unit 633 outputs to the image signal control unit 634 the image of the document read by the image sensor 650*a* (refer to FIG. 1), and the image signal control unit 634 then outputs the received image to the printer control unit 635.

The operation unit 601 includes a plurality of keys for the user to set various functions related to image forming processing, and a display unit for displaying a setting state. The operation unit 601 outputs to the CPU circuit unit 630 key signals corresponding to the various user operations on the keys, and displays on the display unit information based on the signals received from the CPU circuit unit 630.

The CPU circuit unit 630 controls the image signal control unit 634 according to the control programs stored in the ROM 631 and the settings specified on the operation unit 601. Further, the CPU circuit unit 630 controls via a document conveyance apparatus control unit 632 the document conveyance apparatus 651 (refer to FIG. 1). Further, the CPU circuit unit 630 controls the document reading unit 650 (refer to FIG. 1) via the image reader control unit 633, the image forming unit 603 (refer to FIG. 1) via the printer control unit 635, and the finisher 100 via a finisher control unit 636.

According to the present exemplary embodiment, the finisher control unit 636 is installed in the finisher 100 and controls driving of the finisher 100 by exchanging information with the CPU circuit unit 630. Further, the finisher control unit 636 may be integrated with the CPU circuit unit 630 and disposed in the copying machine main body, and directly control the finisher 100 from the copying machine main body side.

Figure 14:
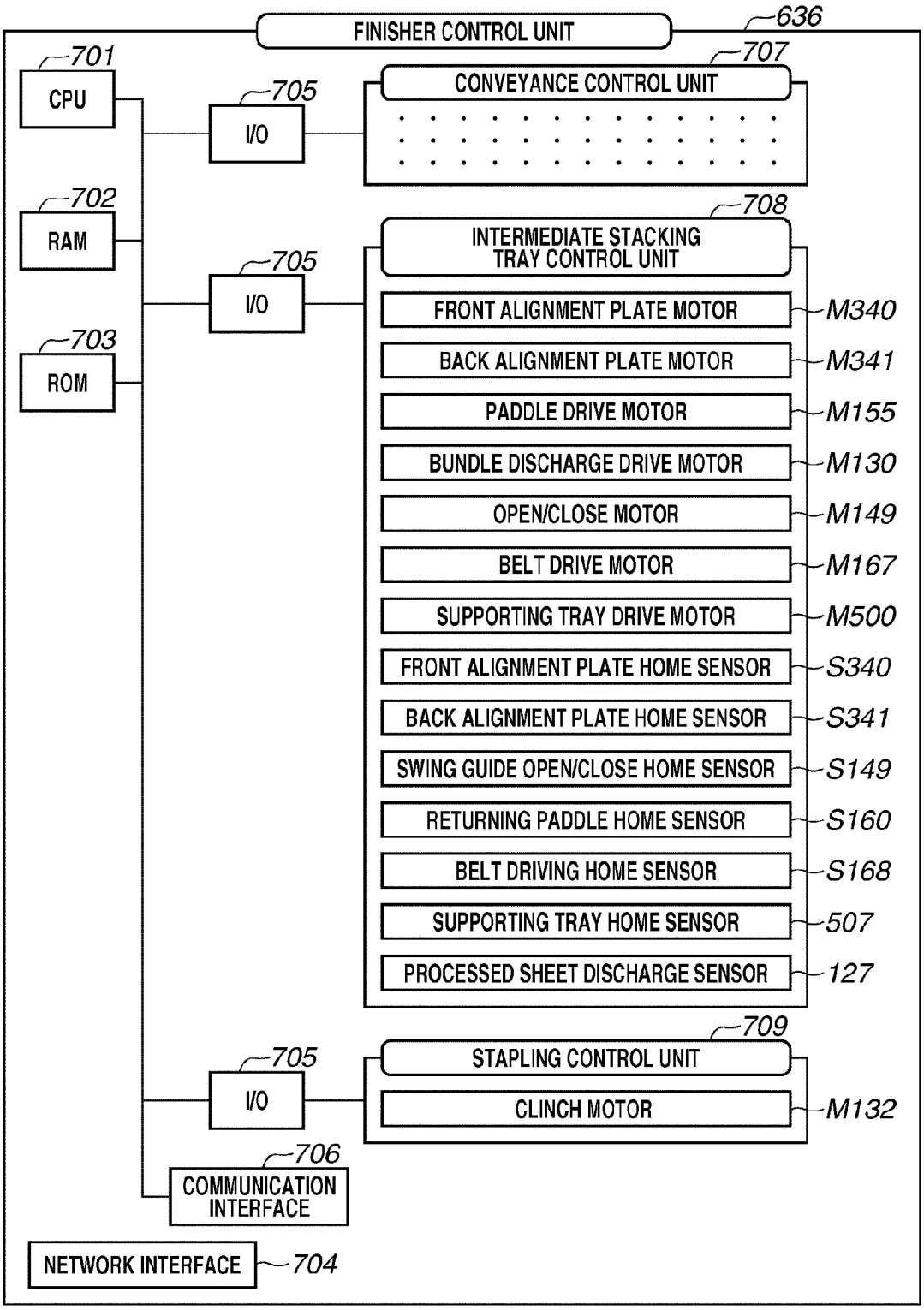
FIG. 14 is a control block diagram illustrating the finisher.

FIG. 14 is a control block diagram illustrating the finisher 100 according to the present exemplary embodiment. Referring to FIG. 14, the finisher control unit 636 includes a CPU (i.e., a microcomputer) 701, a RAM 702, a ROM 703, input/output (I/O) units 705, a communication interface 706, and a network interface 704. The I/O units 705 are connected to a conveyance control unit 707, an intermediate stacking tray control unit 708, and a stapling control unit 709. The conveyance control unit 707 controls lateral registration detection of the sheet, sheet buffering, and sheet conveyance. The intermediate stacking tray control unit 708 controls driving of the front alignment plate motor M340, the back alignment plate motor M341, the paddle drive motor M155, the bundle discharge drive motor M130, the open/close motor M149, the belt drive motor M167, and the supporting tray drive motor M500.

Further, the intermediate stacking tray control unit 708 is connected to a front alignment plate home sensor S340, a back alignment plate home sensor S341, and an open/close home sensor S149. Furthermore, the intermediate stacking tray control unit 708 is connected to a returning paddle home sensor S160, a belt driving home sensor S168, the supporting tray home sensor 507, and a processed sheet discharge sensor 127. Home position detection sensors and moving motors in the intermediate stacking tray control unit 708 respectively control the operations of the front and back alignment plates and the pull-in paddles, the moving operation of the belt roller, and opening and closing of the open/close guide. The stapling control unit 709 controls driving of the clinch motor M132.

Figure 15:
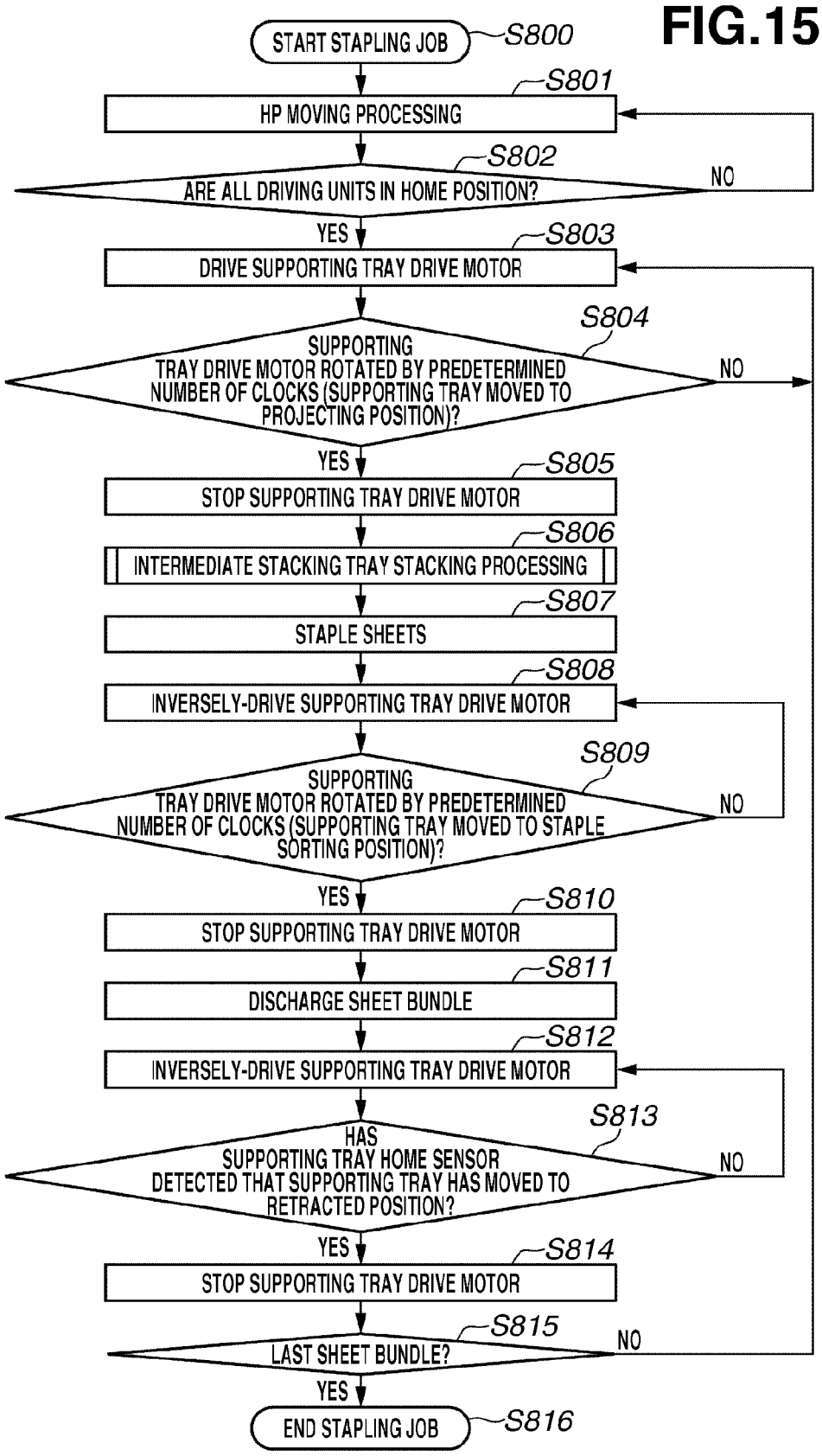
FIG. 15 is a first flowchart illustrating an operation performed by the intermediate stacking tray unit when the finisher performs stapling processing.

The operation performed by the intermediate stacking tray unit when executing stapling processing according to the present exemplary embodiment will be described below with reference to flowcharts illustrated in FIGS. 15, 16, 17, and 18. Referring to FIG. 15, in step S800, the CPU circuit unit 630 starts a stapling job. In step S801, the process proceeds to a home position (HP) moving processing. In step S802, the CPU circuit unit 630 monitors whether all driving units are in the home positions. If not all of the driving units are in the home positions (NO in step S802), the process returns to step S801, and the CPU circuit unit 630 moves the driving units which are not in the home positions to the home positions.

If the home position moving processing is completed (YES in step S802), the process proceeds to step S803. In step S803, the CPU circuit unit 630 drives the supporting tray drive motor M500. More specifically, the CPU circuit unit 630 rotates the supporting tray drive motor M500 by a predetermined number of clocks to move the supporting tray 500A to the projecting position. In step S804, the CPU circuit unit 630 determines whether the supporting tray drive motor M500 has been rotated by a predetermined number of clocks so that the supporting tray 500A has moved to the projecting position as illustrated in FIGS. 7C and 8A. If the CPU circuit unit 630 determines that the supporting tray drive motor M500 has been rotated by a predetermined number of clocks (YES in step S804), the process proceeds to step S805. In step S805, the CPU circuit unit 630 stops the supporting tray drive motor M500. In step S806, the CPU circuit unit 630 then shifts to performing intermediate stacking tray stacking processing illustrated in the flowchart of FIG. 16, after moving the supporting tray 500A to the projecting position.

Figure 16:
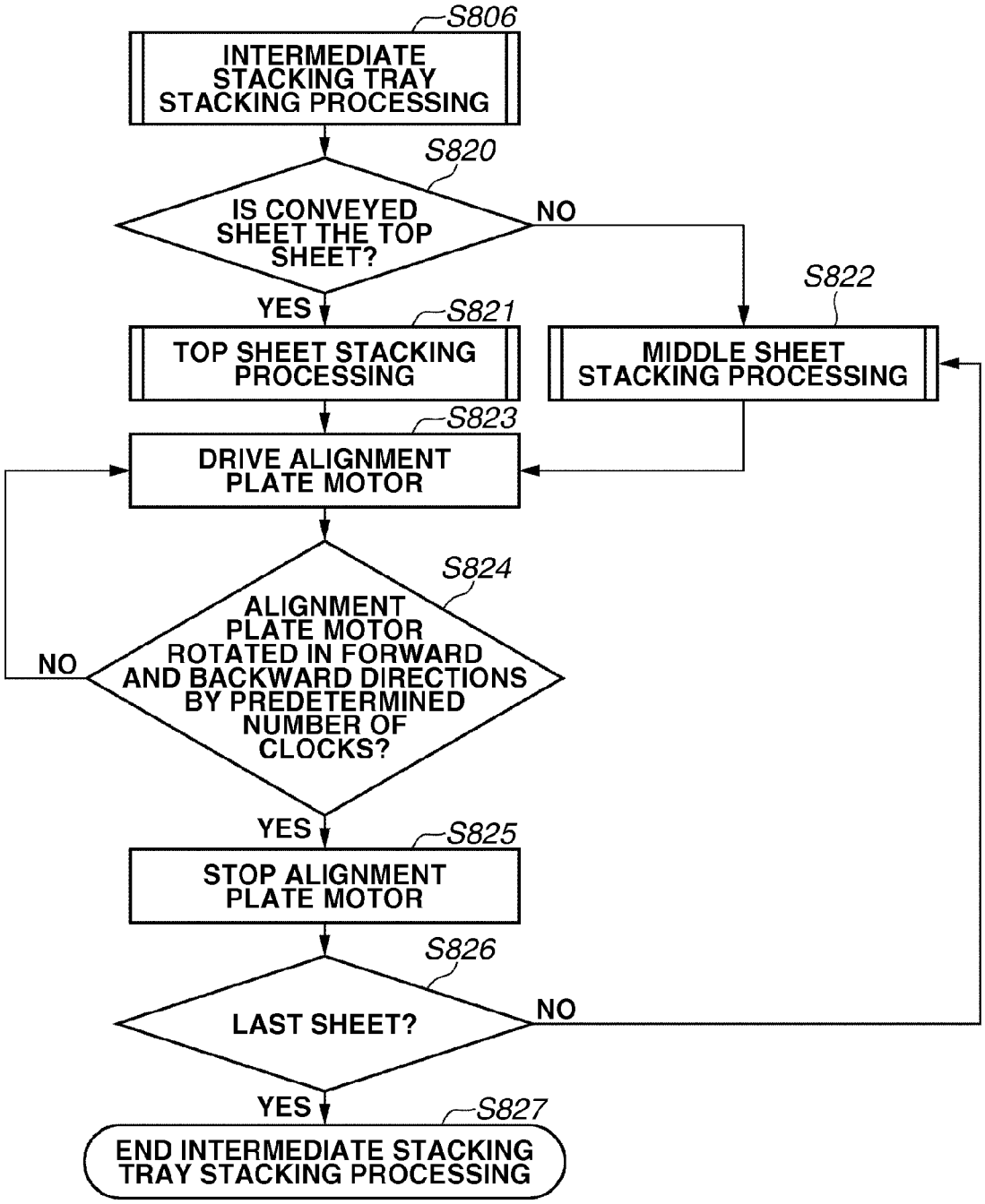
FIG. 16 is a second flowchart illustrating an operation performed by the intermediate stacking tray unit when the finisher performs stapling processing.
Figure 17:
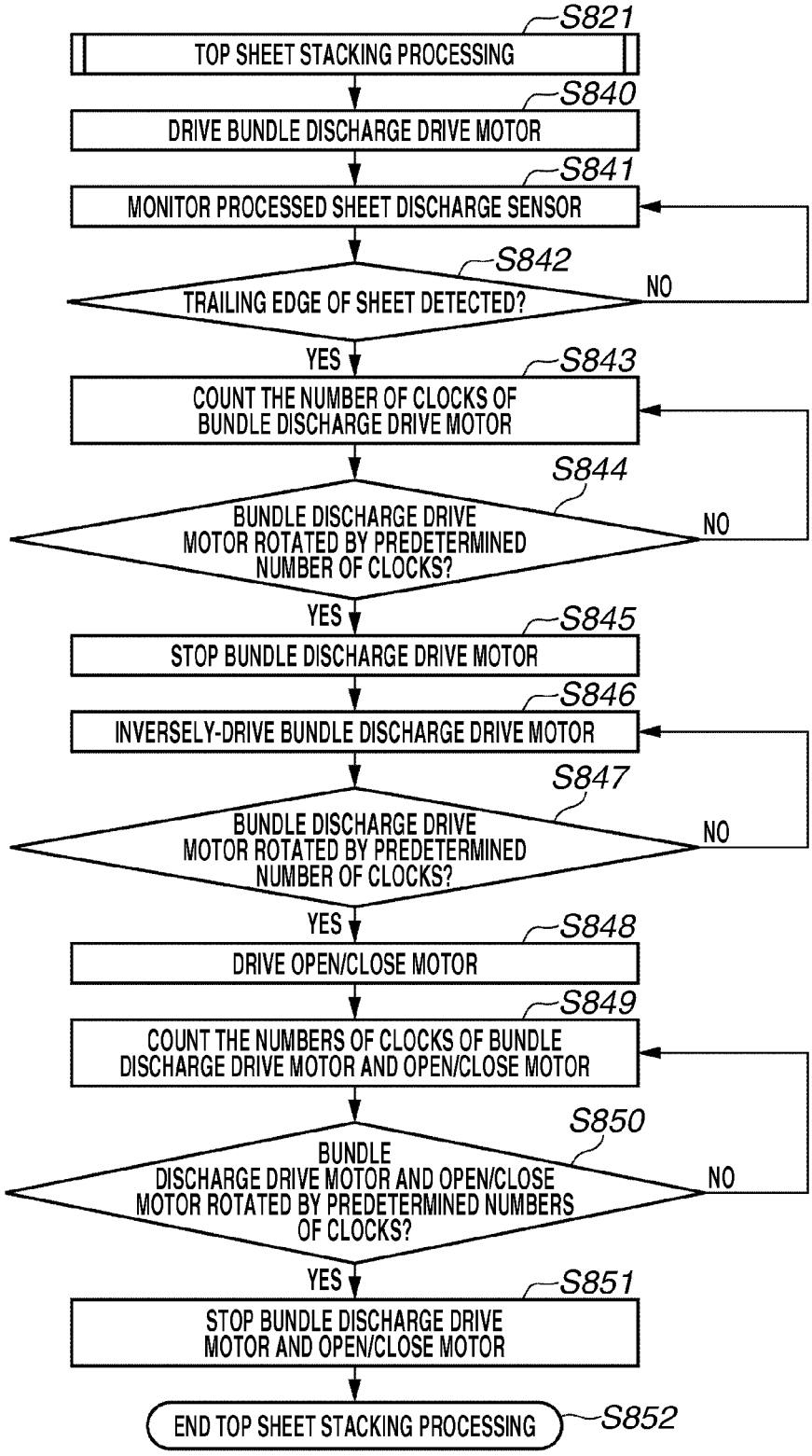
FIG. 17 is a third flowchart illustrating an operation performed by the intermediate stacking tray unit when the finisher performs stapling processing.

Referring to FIG. 16, in step S820, the CPU circuit unit 630 determines whether the sheet to be conveyed to the intermediate stacking tray 138 is the top sheet of the sheet bundle to be stapled. If the sheet to be conveyed is the top sheet (YES in step S820), the process proceeds to step S821. In step S821, the CPU circuit unit 630 performs top sheet stacking processing illustrated in the flowchart of FIG. 17. Referring to FIG. 17, in step S840, the CPU circuit unit 630 drives the bundle discharge drive motor M130. In step S841, the CPU circuit unit 630 monitors the processed sheet discharge sensor 127. In step S842, the CPU circuit unit 630 determines whether the processed sheet discharge sensor 127 has detected the trailing edge of the sheet to be conveyed. If the processing discharge sensor 127 has detected the trailing edge of the sheet to be conveyed (YES in step S842), the process proceeds to step S843. In step S843, the CPU circuit unit 630 counts the number of clocks of the bundle discharge drive motor M130 based on the detection information acquired in step S842. As a result, the CPU circuit unit 630 transfers the top sheet conveyed to the intermediate stacking tray 138 to the bundle discharge roller pair 130, and conveys the sheet in the discharging direction.

In step S844, the CPU circuit unit 630 determines whether the bundle discharge drive motor M130 has been rotated by a predetermined number of clocks. If the bundle discharge drive motor M130 has been rotated by a predetermined number of clocks (YES in step S844), the process proceeds to step S845. In step S845, the CPU circuit unit 630 stops the bundle discharge drive motor M130. In step S846, the CPU circuit unit 630 then inversely-drives the bundle discharge drive motor M130 and conveys the sheet towards the trailing edge stopper 150. In step S847, the CPU circuit unit 630 determines whether the bundle discharge drive motor M130 has been rotated by a predetermined number of clocks. If the bundle discharge drive motor M130 has been rotated by a predetermined number of clocks (YES in step S847), the process proceeds to step S848. In step S848, the CPU circuit unit 630 drives the open/close motor M149. The open/close guide 149 thus rotates, and the nip of the bundle discharge roller pair 130 is released. In step S849, the CPU circuit unit 630 counts the numbers of clocks of the bundle discharge drive motor M130 and the open/close motor M149.

In step S850, the CPU circuit unit 630 determines whether the bundle discharge drive motor M130 and the open/close motor M149 have been rotated by predetermined numbers of clocks. If the bundle discharge drive motor M130 and the open/close motor M149 have been rotated by predetermined numbers of clocks (YES in step S850), the trailing edge of the sheet comes into contact with the trailing edge stopper 150. In step S851, the CPU circuit unit 630 then stops the bundle discharge drive motor M130 and the open/close motor M149. In step S852, the top sheet stacking processing ends.

Figure 18:
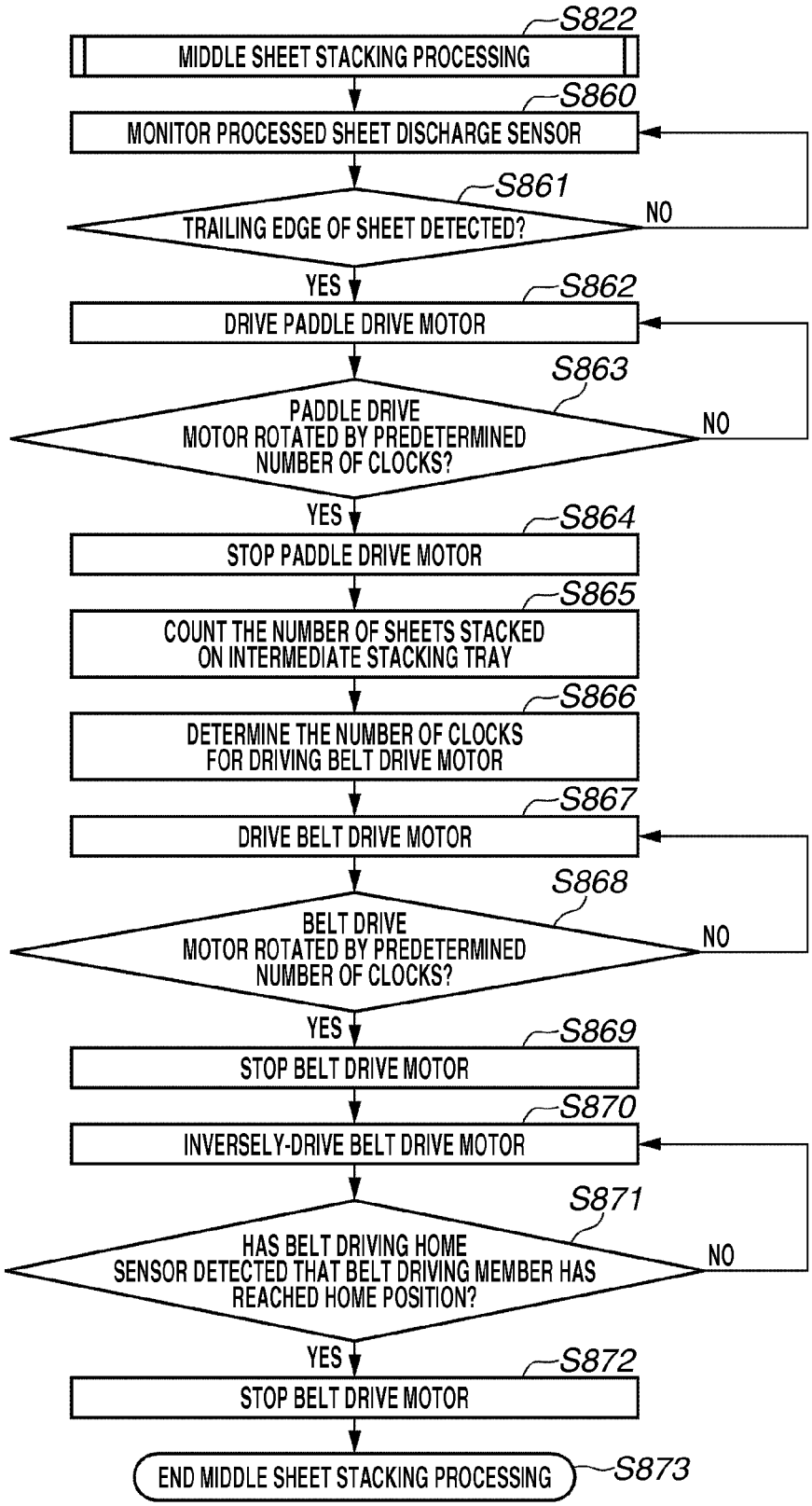
FIG. 18 is a fourth flowchart illustrating an operation performed by the intermediate stacking tray unit when the finisher performs stapling processing.

On the other hand, if the sheet to be conveyed is not the top sheet in the intermediate stacking tray staking processing illustrated in FIG. 16 (NO in step S820), the process proceeds to step S822. In step S822, the process proceeds to middle sheet stacking processing illustrated in the flowchart of FIG. 18. Referring to FIG. 18, in step S860, the CPU circuit unit 630 monitors the processed sheet discharge sensor 127. In step S861, the CPU circuit unit 630 determines whether the processed sheet discharge sensor 127 has detected the trailing edge of the sheet to be conveyed. If the processed sheet discharge sensor 127 has detected the trailing edge of the sheet to be conveyed (YES in step S861), the process proceeds to step S862. In step S862, the CPU circuit unit 630 drives the paddle drive motor M155 based on the detection information. As a result, the CPU circuit unit 630 rotates the pull-in paddle 131 in the anti-clockwise direction, and conveys a middle sheet discharged on the intermediate stacking tray 138 towards the trailing edge stopper 150. In step S863, the CPU circuit unit 630 determines whether the paddle drive motor M155 has been rotated by a predetermined number of clocks. If the paddle drive motor M155 has been rotated by a predetermined number of clocks (YES in step S863), the process proceeds to step S864. In step S864, the CPU circuit unit 630 stops the paddle drive motor M155.

In step S865, the CPU circuit unit 630 counts the number of sheets stacked on the intermediate stacking tray 138 based on the information transmitted from the CPU 629 in the CPU circuit unit 630. In step S866, the CPU circuit unit 630 determines the number of clocks for driving the belt drive motor M167, based on the information. In step S867, the CPU circuit unit 630 then drives the belt drive motor M167. As a result, the belt roller 158 moves to the position at which the belt roller 158 can apply the conveyance force to the sheet on the intermediate stacking tray 138. The belt roller 158 thus further conveys the sheet conveyed by the pull-in paddle 131 towards the trailing edge stopper 150.

In such a case, the thickness of the stacked sheets on the intermediate stacking tray 138 gradually changes according to the number of stacked sheets. The CPU circuit unit 630 thus causes the belt roller 158 to apply proximately constant conveyance force by changing the shape of the belt roller 158 at the contacting position in a lowest portion of the belt roller 158. The CPU circuit unit 630 changes the shape of the belt roller 158 by controlling the displacement of the belt driving member 161.

In step S868, the CPU circuit unit 630 determines whether the belt drive motor M167 has been rotated by the number of clocks determined in step S866. If the belt drive motor M167 has been rotated by the number of clocks determined in step S866 (YES in step S868), the process proceeds to step S869. In step S869, the CPU circuit unit 630 stops the belt drive motor M167. In step S870, the CPU circuit unit 630 inversely-drives the belt drive motor M167, and monitors the belt driving home sensor 168. In step S871, the CPU circuit unit 630 determines whether the belt driving home sensor 168 has detected that the belt driving member 161 has reached the home position. If the belt driving member 161 has reached the home position (YES in step S871), the process proceeds to step S872. In step S872, the CPU circuit unit 630 stops the belt drive motor M167. In step S873, the sheet stacking processing ends.

The process then returns to the intermediate stacking tray stacking processing illustrated in FIG. 16. In step S823, the CPU circuit unit 630 drives, if the sheet is stacked on the intermediate stacking tray 138 by performing the top sheet stacking processing and the middle sheet stacking processing, the front and back alignment plate motors M340 and M341 in the forward and reverse directions. In step S824, the CPU circuit unit 630 determines whether the front and back alignment plate motors M340 and M341 have been rotated in the forward and reverse directions by a predetermined number of clocks. If the front and back alignment plate motors M340 and M341 have been rotated in the forward and reverse directions by a predetermined number of clocks (YES in step S824), the process proceeds to step S825. In step S825, the CPU circuit unit 630 stops the front and back alignment plate motors M340 and M341 after aligning the position of the sheet in the width direction.

In step S826, the CPU circuit unit 630 determines whether the sheet which has been aligned in the width direction thereof is the last sheet in the sheet bundle to be stapled. If the CPU circuit unit 630 determines that the sheet is not the last sheet (NO in step S826), the process again proceeds to the middle sheet stacking processing performed in step S822. If the sheet is the last sheet (YES in step S826), the process proceeds to step S827. In step S827, the intermediate stacking tray stacking processing ends.

Returning to the flowchart illustrated in FIG. 15, after the intermediate stacking tray stacking processing performed in step S806 ends, the process proceeds to step S807. In step S807, the CPU circuit unit 630 uses the stapler 132 to staple the sheet bundle stacked on the intermediate stacking tray 138. In step S808, the CPU circuit unit 630 then drives the supporting tray drive motor M500 to move the supporting tray 500A from the projecting position to the staple sorting position as illustrated in FIGS. 7B and 8C, for example. In step S809, the CPU circuit unit 630 determines whether the supporting tray drive motor M500 has been rotated by a predetermined number of clocks and that the supporting tray 500A has been moved to the staple sorting position. If the supporting tray 500A has been moved to the staple sorting position (YES in step S809), the process proceeds to step S810. In step S810, the CPU circuit unit 630 stops the supporting tray drive motor M500.

In step S811, the CPU circuit unit 630 discharges the sheet bundle. More specifically, the CPU circuit unit 630 drives the open/close motor M149 and the bundle discharge drive motor M130 and discharges the stapled sheet bundle stacked on the intermediate tray 138 towards the stacking tray 137. The discharged sheet bundle then falls onto the stacking tray 137, and the trailing edge thereof is mounted on the supporting tray 500A in the staple sorting position as illustrated in FIG. 9A, due to the self-weight and the tilt of the stacking tray 137.

In step S812, the CPU circuit unit 630 further inversely-drives the supporting tray drive motor M500. The CPU circuit unit 630 thus moves the supporting tray 500A from the staple sorting position to the retracted position illustrated in FIG. 9C. Upon moving the supporting tray 500A, the CPU circuit unit 630 pulls out the supporting tray 500A from between the sheet bundle and the previously stacked stapled sheet bundle, so that the discharged sheet bundle becomes stacked on the previously stacked stapled sheet bundle. The CPU circuit unit 630 pulls in the sheet stacked on the supporting tray 500A at the same time, so that the pull-in force is added to the returning force due to self-weight, and the sheet is reliably transferred to the stacking wall 170.

In step S813, the CPU circuit unit 630 monitors the supporting tray home sensor 507, and determines whether the supporting tray home sensor 507 has detected that the supporting tray 500A has moved to the retracted position. If the supporting tray home sensor 507 has detected that the supporting tray 500A has moved to the retracted position (YES in step S813), the process proceeds to step S814. In step S814, the CPU circuit unit 630 stops the supporting tray drive motor M500. In step S815, the CPU circuit unit 630 determines whether the discharged sheet bundle is the last sheet bundle. If the CPU circuit unit 630 determines that the discharged sheet bundle is not the last sheet bundle (NO in step S815), the process returns to step S803. If the CPU circuit unit 630 determines that the discharged sheet bundle is the last sheet bundle (YES in step S815), the stapling job ends.

As described above, according to the present exemplary embodiment, when the finisher 100 discharges the sheet bundle, the supporting tray 500A supports the sheet bundle. The supporting tray 500A then stops supporting the sheet bundle at the predetermined timing, and stacks the sheet bundle on the sheet bundle previously stacked on the stacking tray 137. As a result, there is no interference by the stapled portion of the sheet bundle previously stacked on the stacking tray 137, so that the alignment property of the stapled sheet bundles is improved.

In the above-described exemplary embodiment, the orientation retaining member 521 controls the orientation of the moving guide 501 in the supporting tray 500A when the moving guide 501 moves to the staple sorting position. However, the present invention is not limited to the above. For example, the supporting tray 500A may cause an angle changing unit to change the rotation angle of the movable guide 501 when moving to the staple sorting position.

Figure 19A:
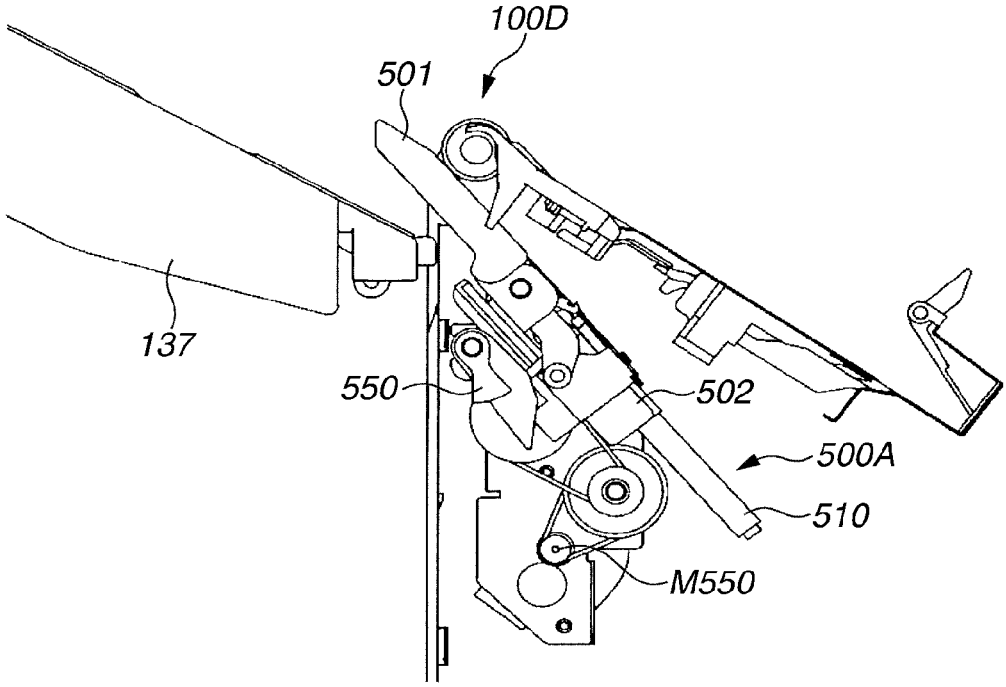
FIGS. 19A and 19B illustrate a configuration of the stapling unit included in the finisher according to a second exemplary embodiment.
Figure 19B:
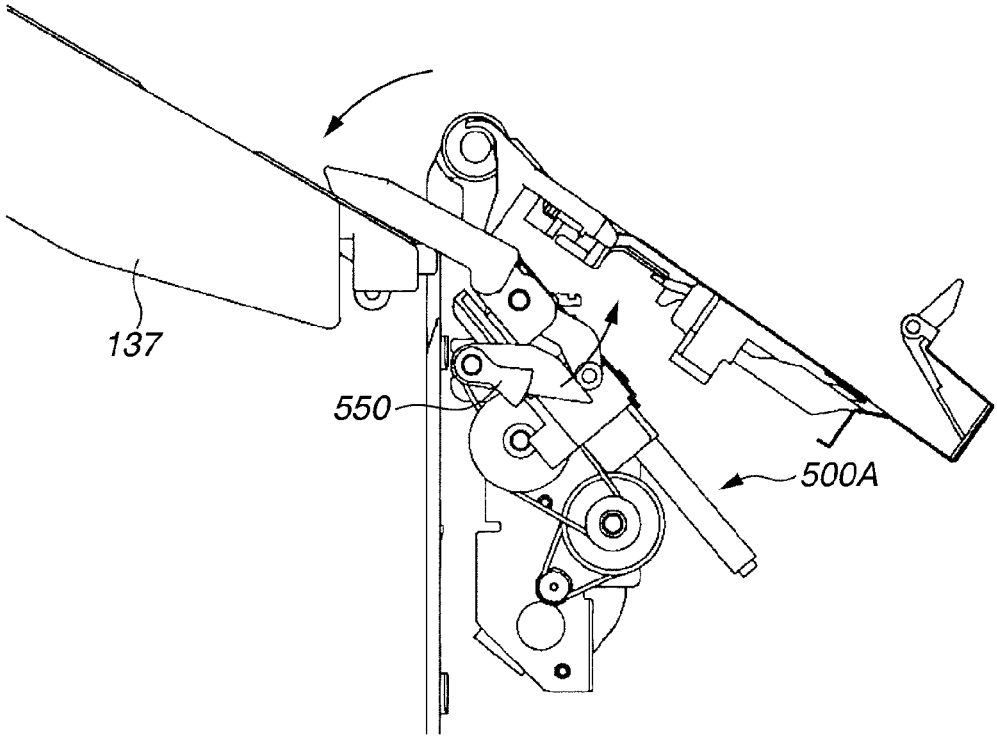

A second exemplary embodiment according to the present invention which includes the above-described angle changing unit will be described below. FIGS. 19A and 19B respectively illustrate a configuration of the stapling unit included in the finisher (i.e., the sheet processing apparatus) according to the present exemplary embodiment. The components illustrated in FIGS. 19A and 19B which are similar or correspond to the components illustrated in FIG. 3 are assigned the same reference numerals.

Referring to FIGS. 19A and 19B, a rotating lever 550 is an angle changing unit which changes the rotation angle of the movable guide 501. The rotating lever 550 rotates independent of a forward/backward operation of the movable guide 501. Further, the rotating lever 550 is disposed near the discharge port 100D and below the movable guide 501, and is rotated by a rotating lever drive motor M550.

According to the present exemplary embodiment, when the supporting tray 500A is in the staple sorting position, the finisher 100 rotates the rotating lever 550 and pushes up the back portion of the movable guide 501. The movable guide 501 is thus rotated from the position illustrated in FIG. 19A to the direction in which the leading edge becomes closer to the stacking tray 137 as illustrated in FIG. 19B. A spring (not illustrated) biases the movable guide 501 in the clockwise direction, so that the movable guide 501 retains the same orientation as in the projecting position unless the rotating lever 550 changes the orientation thereof.

Figure 20:
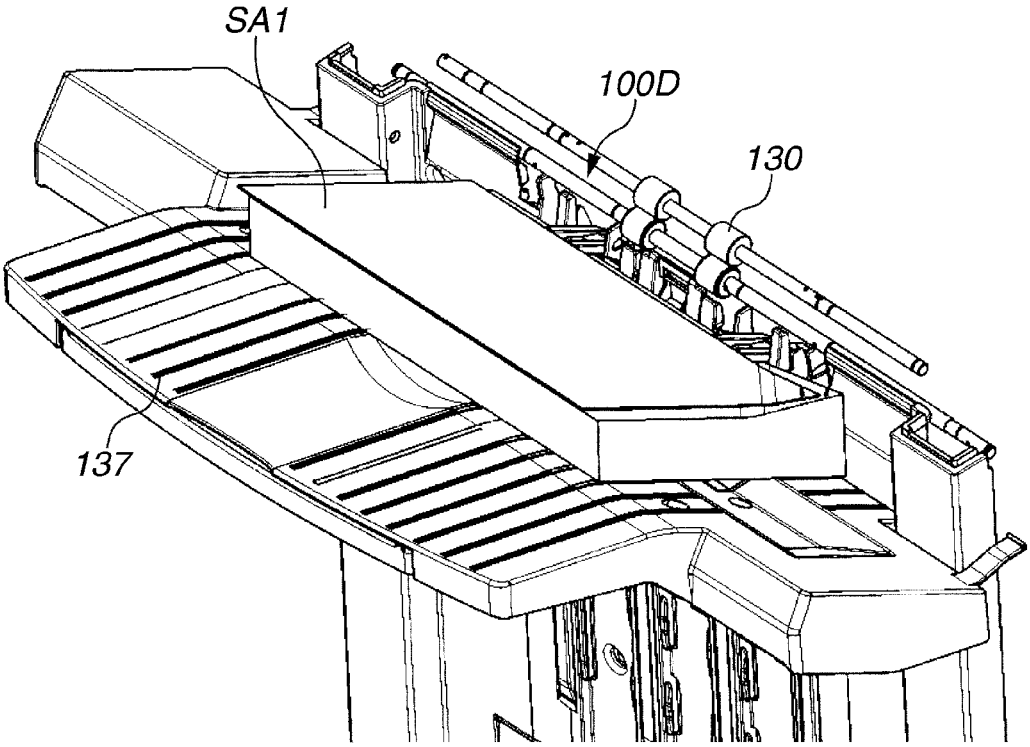
FIG. 20 illustrates a state where the sheet bundle is stacked on the stacking tray included in the stapling unit illustrated in FIGS. 19A and 19B.
Figure 21:
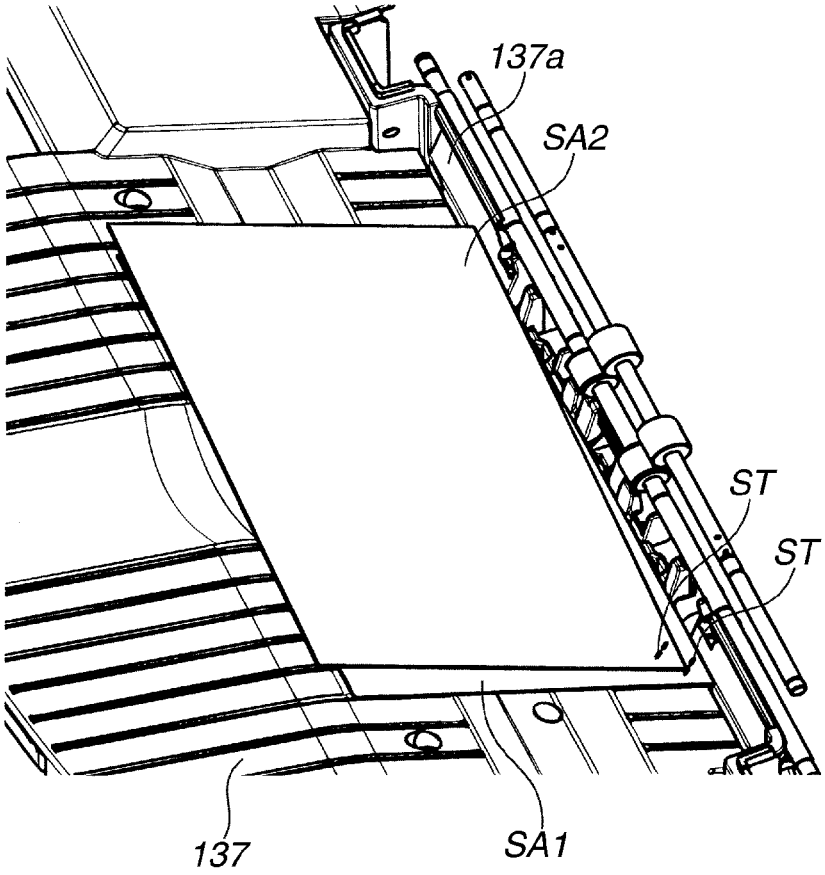
FIG. 21 illustrates a conventional sheet processing apparatus.

According to the present exemplary embodiment, the finisher 100 rotates the rotating lever 550 and changes the rotation angle of the movable guide 501. The orientation of the movable guide 501 in the staple sorting position can thus be set to an arbitrary position, and sorting to avoid the stapled portion can be performed. For example, if the stapled sheet bundles are sequentially stacked on the stacking tray 137 as illustrated in FIG. 20, and the bundles are stapled at one location, the shape of the paper surface changes due to stacking of the stapled portion. The stapled portion thus becomes elevated in the paper surface.

To prevent such an elevation of the stapled portion, it is desirable for a height position of the movable guide 501 in the staple sorting position to be higher by a small amount as compared to the state at the start of stacking the sheet bundles, so that a phenomenon as illustrated in FIG. 20 is not generated. According to the present exemplary embodiment, the finisher 100 thus controls a rotating amount of the rotating lever 550 and changes the rotation angle of the movable guide 501 in the staple sorting position. The finisher 100 changes the rotation angle according to the number of sheets to be stapled in the sheet bundle discharged to the stacking tray 137, the number of discharged sheet bundles, and a stapling method with respect to the sheet bundle.

In other words, if the stapled portion is elevated in the paper surface of the sheet bundles stacked on the stacking tray 137, the finisher 100 reduces the rotating amount of the rotating lever 550 and elevates the height position of the movable guide 501 in the staple sorting position. The finisher 100 thus changes the orientation of the movable guide 501 according to the state in which the sheet bundles are stacked on the stacking tray 137, so that the stacking property of the stapled sheet bundles is further improved.

According to the above-described exemplary embodiment, the alignment property of the sheet bundles which have been stapled using the staples is improved. However, the present disclosure is not limited to the above. For example, the present invention may be applied to a case where the alignment property is improved for the sheet bundles which are irregularly-shaped due to stapling of unevenly-shaped sheets, and the sheet bundles having burrs due to punching holes in the sheets.

While described with reference to exemplary embodiments, it is to be understood that the disclosure is not limited to the disclosed exemplary embodiments. The scope of the following claims is to be accorded the broadest interpretation so as to encompass all modifications, equivalent structures, and functions.

This application claims priority from Japanese Patent Application No. 2011-167586 filed Jul. 29, 2011, which is hereby incorporated by reference herein in its entirety.

What is claimed is:

1. A sheet processing apparatus comprising:

a sheet processing portion configured to process a sheet bundle;

a sheet stacking portion configured to stack thereon the sheet bundle discharged from a discharge port after being processed on the sheet processing portion;

a regulating portion disposed below the discharge port and configured to regulate a position of an upstream edge, in a discharging direction of the sheet bundle discharged to the sheet stacking portion;

a sheet supporting portion configured to support the sheet bundle;

a moving portion configured to move the sheet supporting portion to a first position where the sheet supporting portion projects above the sheet stacking portion to support an upstream edge portion of the sheet bundle discharged from the discharge port, a second position where the sheet supporting portion releases supporting the upstream edge portion of the sheet bundle to stack the discharged sheet bundle on a sheet bundle previously stacked on the sheet stacking portion, and a stacking position where the sheet supporting portion supports a sheet bundle being processed by the sheet processing portion, the stacking position being above the first position; and a control portion configured to control the moving portion so that, after a sheet bundle is processed by the sheet processing portion, the sheet supporting portion is moved from the stacking position to the first position to support the upstream edge portion of the sheet bundle discharged from the discharge port, and sheet supporting portion is moved from the first position to the second position while the upstream edge portion of the sheet bundle is on the sheet supporting portion so as to pull the upstream edge of the sheet bundle to contact with the regulating portion.

2. The sheet processing apparatus according to claim 1, wherein the control portion controls the movement of the moving portion so that the sheet supporting portion is moved to the first position before completing discharge of the sheet bundle to the sheet stacking portion, and starts to move toward the second position before the upstream edge, in the discharging direction, of the discharged sheet bundle comes into contact with the regulating portion.

3. The sheet processing apparatus according to claim 1, further comprising:

a slide member configured to move slidably, and a movable guide member rotatably attached to the slide member and provided with the sheet supporting portion to support the sheet bundle, and wherein the movable guide member rotates downwards relative to the slide member thereby the sheet supporting portion moves from the stacking position to the first position.

4. The sheet processing apparatus according to claim 3, wherein the movable guide member rotates, when the sheet supporting portion moves to the first position, so that a downstream edge of the movable guide member in the discharging direction is positioned towards the sheet stacking portion as compared to a straight line running through a downstream edge position of the movable guide member in the discharging direction when the sheet supporting portion has moved to the second position of the sheet supporting portion and the downstream edge position in the discharging direction when the sheet supporting portion has moved to the stacking position.

5. The sheet processing apparatus according to claim 3, further comprising:

a regulating portion configured to come into contact with the movable guide member and regulate a rotation angle of the movable guide member, wherein the movable guide member rotates by moving a position of contact with the regulating portion along with sliding of the slide member.

6. The sheet processing apparatus according to claim 3, further comprising:

an angle changing portion configured to change a rotation angle of the movable guide member when the sheet supporting portion has moved to the first position.

7. The sheet processing apparatus according to claim 6, wherein the sheet processing portion is a stapling portion to bind a sheet bundle using a staple, and the angle changing portion changes a rotation angle of the movable guide member based on at least one of a number of stapled sheets in a sheet bundle to be discharged, a number of sheet bundles to be discharged, and a sheet bundle stapling method.

8. The sheet processing apparatus according to claim 3, wherein the moving unit includes the driving unit to slide the slide member, and wherein the movable guide member rotates relative to the slide member along with sliding of the slide member by the driving unit.

9. The sheet processing apparatus according to claim 3, wherein the moving unit includes the driving unit to slide the slide member, and wherein the sheet supporting portion moves from the first position to the second position along with sliding of the slide member by the driving unit.

10. The sheet processing apparatus according to claim 3, wherein the movable guide member rotates relative to the slide member along with sliding of the slide member in a predetermined direction thereby the sheet supporting portion moves from the stacking position to the first position, and the sheet supporting portion moves from the first position to the second position along with further sliding of the slide member in the predetermined direction.

11. The sheet processing apparatus according to claim 1, wherein the sheet processing portion is a stapling portion to bind a sheet bundle using a staple.

12. The sheet processing apparatus according to claim 1, wherein the movable guide member rotates, when the sheet supporting portion moves to the first position, so that a downstream edge of the movable guide member in the discharging direction is positioned towards the sheet stacking portion as compared to a straight line running through a downstream edge position of the movable guide member in the discharging direction when the sheet supporting portion has moved to the second position of the sheet supporting portion and the downstream edge position in the discharging direction when the sheet supporting portion has moved to the stacking position.

13. An image forming apparatus comprising:

an image forming portion configured to form an image on a sheet;

a sheet processing portion configured to process a sheet bundle;

a sheet stacking portion configured to stack thereon the sheet bundle discharged from a discharge port after being processed on the sheet processing portion;

a regulating portion disposed below the discharge port and configured to regulate a position of an upstream edge, in a discharging direction, of the sheet bundle discharged to the sheet stacking portion;

a sheet supporting portion configured to support sheet bundle;

a moving portion configured to move the sheet supporting portion to a first position where the sheet supporting portion projects above the sheet stacking portion to support an upstream edge portion of the sheet bundle discharged from the discharge port, a second position where the sheet supporting portion releases supporting the upstream edge portion of the sheet bundle to stack the discharged sheet bundle on a sheet bundle previously stacked on the sheet stacking portion and a stacking position where the sheet supporting portion supports a sheet bundle being processed by the sheet processing portion, the stacking position being above the first position; and a control portion configured to control the moving portion so that, after a sheet bundle is processed by the sheet processing portion, the sheet supporting portion is moved from the stacking position to the first position to support the upstream edge portion of the sheet bundle discharged from the discharge port, and the sheet supporting portion is moved from the first position to the second position while the upstream edge portion of the sheet bundle is on the sheet supporting portion so as to pull the upstream edge of the sheet bundle to contact with the regulating portion.

* * * * *